US008651480B2

(12) United States Patent
Watanabe et al.

(10) Patent No.: US 8,651,480 B2
(45) Date of Patent: Feb. 18, 2014

(54) SHEET STACKING APPARATUS AND IMAGE FORMING APPARATUS

(75) Inventors: Kiyoshi Watanabe, Matsudo (JP); Hideki Kushida, Moriya (JP); Toshiyuki Iwata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/545,247

(22) Filed: Jul. 10, 2012

(65) Prior Publication Data

US 2013/0026703 A1 Jan. 31, 2013

(30) Foreign Application Priority Data

Jul. 29, 2011 (JP) ..... 2011-167589
Apr. 27, 2012 (JP) ..... 2012-103012

(51) Int. Cl.
*B65H 31/36* (2006.01)

(52) U.S. Cl.
USPC ..... 271/221; 271/222

(58) Field of Classification Search
USPC ..... 271/220–222; 270/58.12, 58.16, 58.17, 270/58.27
See application file for complete search history.

(56) References Cited

U.S. PATENT DOCUMENTS

| | | | |
|---|---|---|---|
| 6,871,851 | B2 | 3/2005 | Tamura et al. |
| 7,703,757 | B2 | 4/2010 | Watanabe et al. |
| 7,874,553 | B2 | 1/2011 | Kushida et al. |
| 8,146,904 | B2 | 4/2012 | Watanabe et al. |
| 8,172,224 | B2 | 5/2012 | Kushida |
| 2002/0079642 | A1 | 6/2002 | Tamura et al. |
| 2012/0235350 | A1 | 9/2012 | Watanabe et al. |
| 2012/0237280 | A1 | 9/2012 | Yoshimura et al. |

*Primary Examiner* — Michael McCullough
(74) *Attorney, Agent, or Firm* — Fitzpatrick, Cella, Harper & Scinto

(57) ABSTRACT

A finisher 100 includes a pair of bundle discharge rollers 130, a lower stack tray 137, and a width-direction aligning portion 200. The width-direction aligning portion includes a pair of aligning members 1 and a driving motor. The aligning member includes a pair of first aligning members 91 that is rotatably supported while being movable in the sheet width direction orthogonal to the discharge direction and a pair of second aligning members 92. The driving motor rotates the pair of first aligning members and moves the pair of first aligning members in the width direction. When the pair of first aligning members rotates and one of the pair of second aligning members abuts on the sheet, the pair of second aligning members forms opposite surfaces in which the sheet can be aligned in the width direction, and the pair of first aligning members align the sheet by the opposite surfaces.

20 Claims, 24 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus, particularly to a sheet stacking apparatus that can align a sheet stacked on a sheet stacking portion and an image forming apparatus provided therewith.

2. Description of the Related Art

Conventionally, there is well known a sheet stacking apparatus that aligns the sheet, which is discharged to the sheet stacking portion that stacks the sheet thereon, in a sheet width direction orthogonal to a discharge direction to improve a property of taking the sheet on which an image is formed (see U.S. Patent Application Publication No. 2002/0079642 A1).

The sheet stacking apparatus disclosed in U.S. Patent Application Publication No. 2002/0079642 A1 includes a pair of aligning members that can rotate about an upper part of the sheet stacking portion to align the sheet in a lower end part, and each of the pair of aligning members is abutted on an end face in the sheet width direction to perform the alignment in sheet width direction. For example, in the sheet stacking apparatus, one of the pair of aligning members is moved in the sheet width direction, and the sheet is pressed against the other aligning member that is of a reference, thereby performing the alignment in the sheet width direction. The sheet stacking apparatus can also align and sort each of an unbound sheet bundle to which a stapling process is not performed in a position shifted (deviated) in the sheet width direction as needed basis.

The sheet is discharged to the sheet stacking portion not only one by one but also in units of sheet bundles. Therefore, generally a discharge portion that discharges the sheet can swing vertically such that an opening amount of the discharge portion can be changed according to a thickness of the discharged sheet bundle, and the pair of aligning members is disposed above the discharge portion so as not to interfere with the sheet bundle discharged from the discharge portion.

In the sortation stack in which subsequent sheet bundle is aligned in the position shifted in the sheet width direction with respect to the previously-stacked sheet bundle, sometimes the sheet aligned in the sheet width direction passes below the pair of aligning members when the sheet of the subsequent sheet bundle is aligned one by one by the pair of aligning members. In order to prevent the trouble, it is necessary that, in performing an aligning process, the sheet-pressing-side aligning member be located below the reference-side aligning member placed on the previously-stacked sheet bundle. However, as described above, the pair of aligning members is disposed above the discharge portion, and rotatably supported with the upper part of the discharge portion as a rotating center. Therefore, when the pair of aligning members is rotated such that one of the aligning members is moved downward, a position of an alignment region of the pair of aligning members in the discharge direction changes by a rotating radius of the aligning member with respect to the discharged sheet. When the sheet is nipped by the pair of aligning members, which are deviated from each other in the discharge direction, a torque is provided to the sheet in pressing the sheet, and possibly the sheet is inclined.

An object of the invention is to provide a sheet stacking apparatus including a pair of aligning members that can suitably align the sheet in the sheet width direction orthogonal to the discharge direction and an image forming apparatus.

SUMMARY OF THE INVENTION

According to the present invention, there is provided a sheet stacking apparatus including a discharge portion which discharges a sheet, a sheet stacking portion on which the sheet discharged by the discharge portion is stacked, an aligning portion which includes a pair of aligning arms and a pair of aligning members, the pair of aligning arms being supported while being vertically rotatable and movable in a width direction orthogonal to a discharge direction of the sheet, the pair of aligning members being supported at a leading end of the pair of aligning arms while being vertically rotatable, a driving unit which rotates the pair of aligning arms and moves the pair of aligning arms in the width direction, and a controller which controls the driving portion. The controller controls the driving portion, when the sheet discharged by the discharge portion is aligned in a position which is deviated in the width direction with respect to the sheet previously stacked on the sheet stacking portion, so that the driving portion rotates the pair of aligning arms downwardly to rotate one of the pair of aligning members upwardly by abutting on an upper surface of a sheet previously stacked on the sheet stacking portion. The controller then controls the driving portion so that the driving portion moves the pair of aligning arms to align the discharged sheet in the width direction by one of the pair of aligning members and the other of the pair of aligning members, which does not abut on the sheet previously stacked on the sheet stacking portion.

According to the present invention, the pair of aligning members that align the sheet in the sheet width direction is formed in the bendable manner to suppress the change of the sheet alignment region, which allows the sheet to be suitably aligned.

Further features of the present invention will become apparent from the following description of exemplary embodiments with reference to the attached drawings.

DESCRIPTION OF THE EMBODIMENTS

Hereinafter an image forming apparatus according to an embodiment of the invention will be described with reference to the drawings. The image forming apparatus of the embodiment is one, such as a copying machine, a printer, a facsimile machine, and a multifunction peripheral, which includes a sheet stacking apparatus that can align a sheet stacked on a sheet stacking portion in a sheet width direction (hereinafter simply referred to as a "width direction") orthogonal to a discharge direction. In the embodiment, a black-and-white/color copying machine (hereinafter simply referred to as a "copying machine") 1000 is described as the image forming apparatus.

Figure 1:
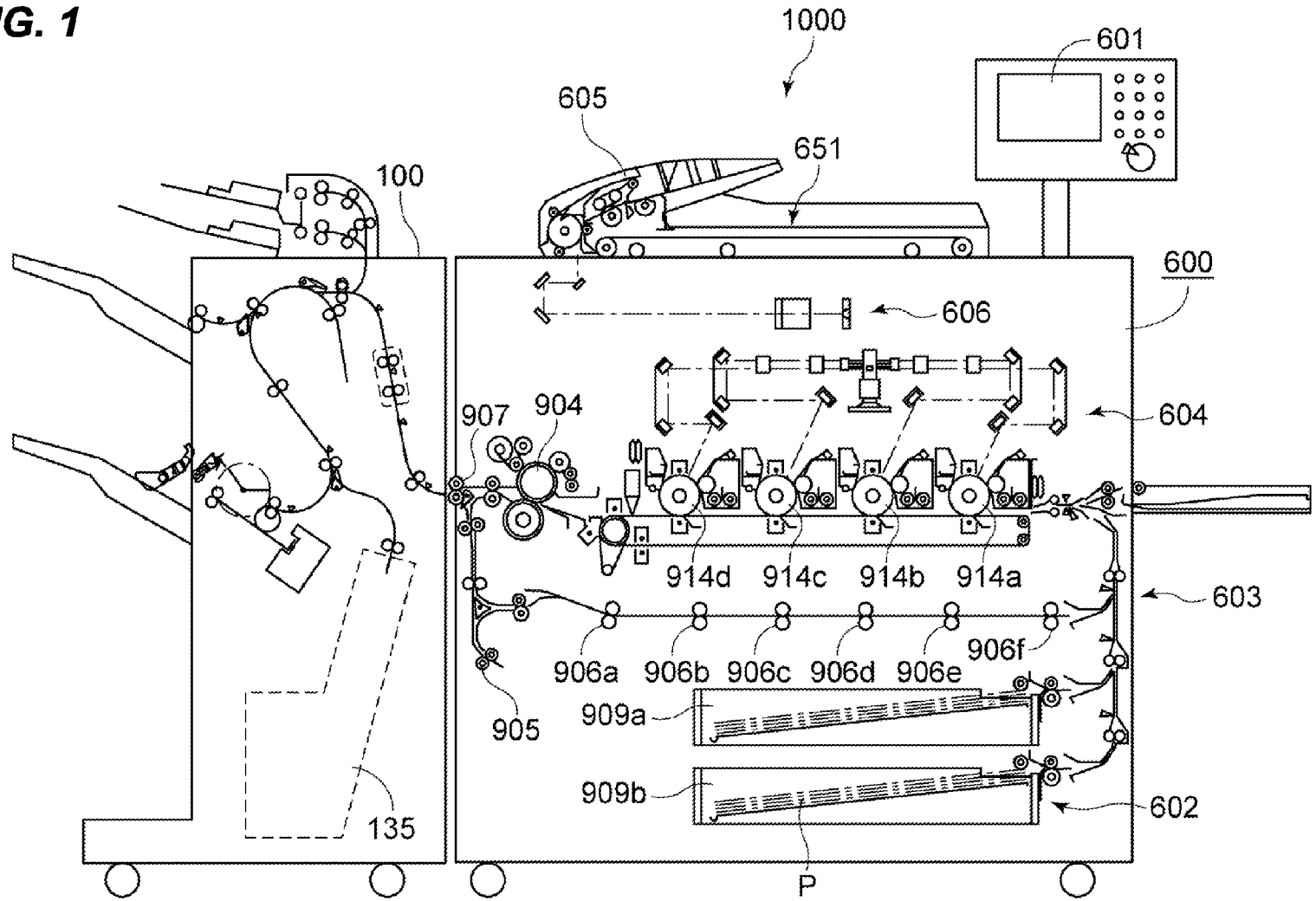
FIG. 1 is a sectional view schematically illustrating a copying machine according to an embodiment of the invention.
Figure 2:
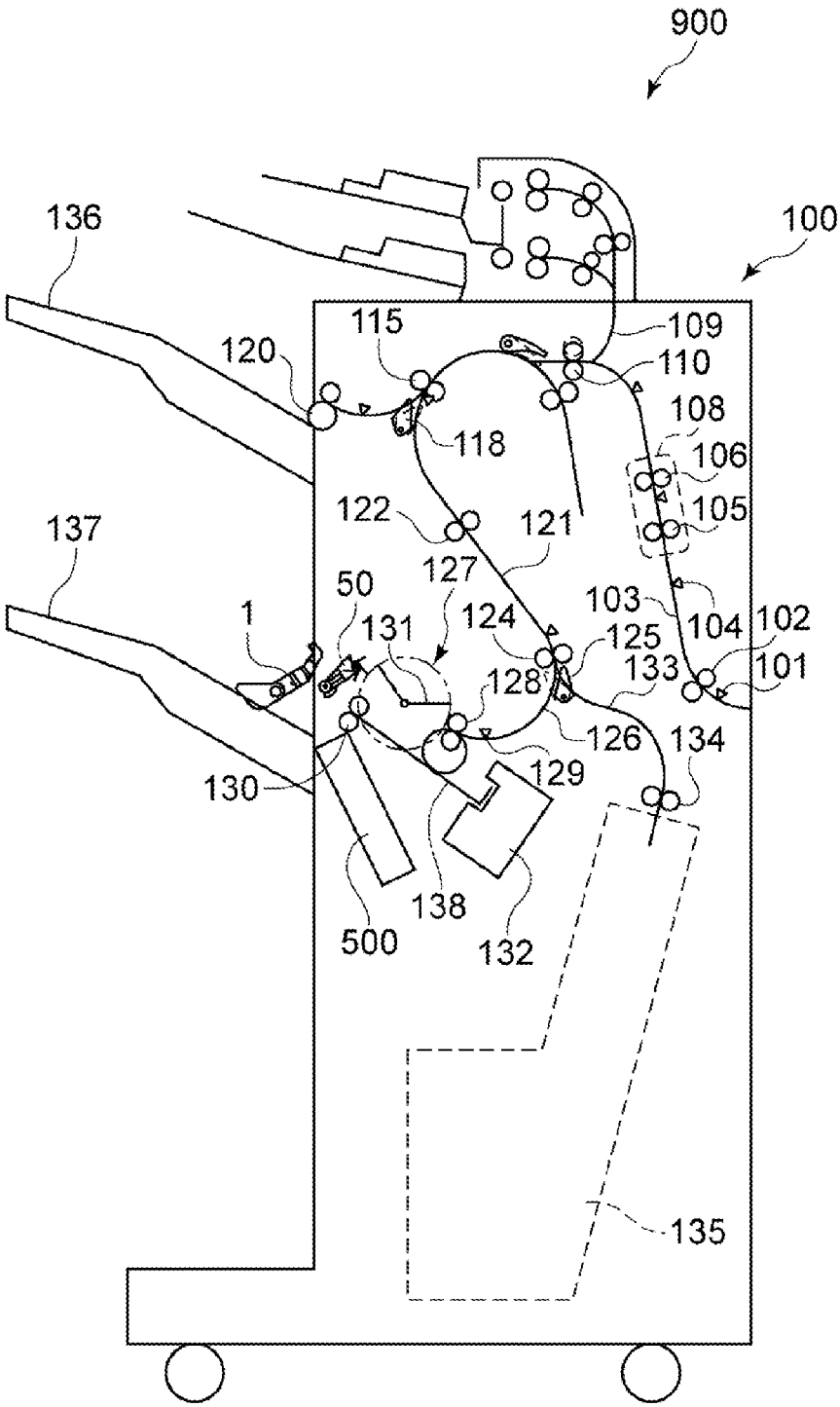
FIG. 2 is a sectional view schematically illustrating a finisher of the embodiment.
Figure 3A:
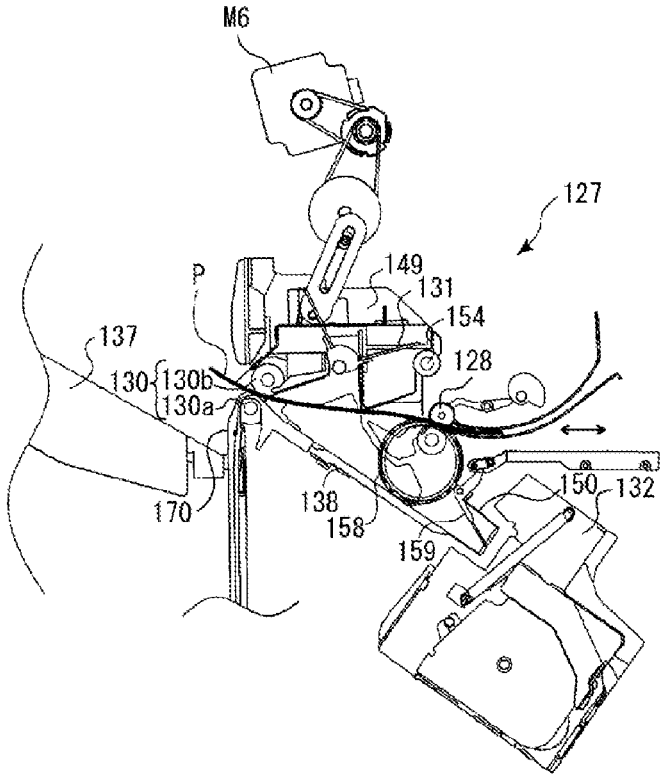
FIG. 3A is a view schematically illustrating a state in which a sheet is conveyed to a stapling portion of the embodiment.
Figure 3B:
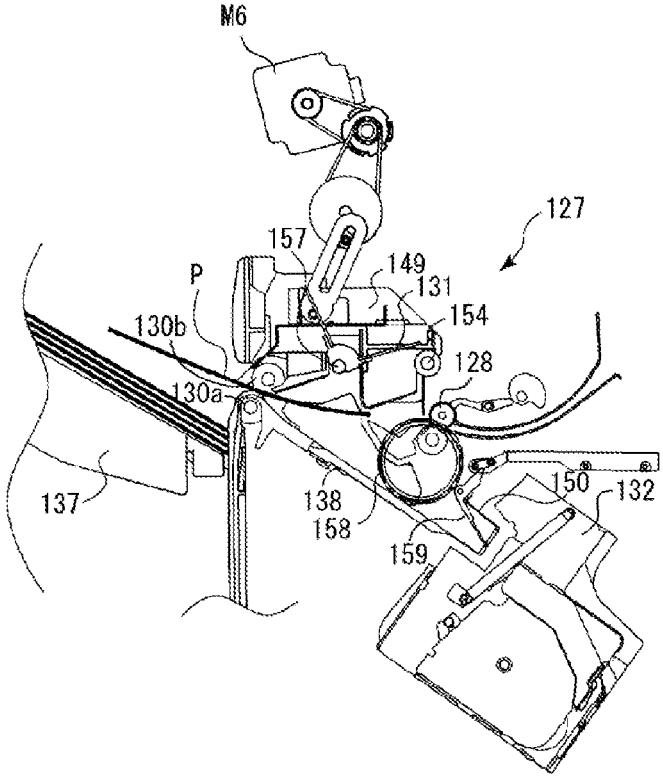
FIG. 3B is a view illustrating a sheet discharging state when a stapling process is not performed.

The copying machine 1000 of the embodiment will be described with reference to FIGS. 1 to 24D. Referring to FIGS. 1 to 3B, an entire configuration of the copying machine 1000 will be described along movement of a sheet P. FIG. 1 is a sectional view schematically illustrating the copying machine 1000. FIG. 2 is a sectional view schematically illustrating a finisher 100 of the embodiment. FIG. 3A is a view schematically illustrating a state in which a sheet is conveyed to a stapling portion 127 of the embodiment. FIG. 3B is a view illustrating a sheet discharging state when a stapling process is not performed.

As illustrated in FIG. 1, the copying machine 1000 includes a copying machine main body 600 that forms an image on a sheet P and the finisher 100 that is of the sheet stacking apparatus. The finisher 100 is configured to be detachably attached to the copying machine main body 600, and the finisher 100 can be used as an optional extra while the copying machine main body 600 can also be used by itself.

Although the detachable finisher 100 is used in the embodiment, the finisher 100 and the copying machine main body 600 may integrally be configured. Hereinafter, a position in which a user faces an operation portion 601 used to perform various inputs and settings to the copying machine 1000 is referred to as a "front side" of the copying machine 1000, and a rear surface side of the copying machine 1000 is referred to as a "back side." That is, FIG. 1 illustrates an internal configuration of the copying machine 1000 when viewed from the front side, and the finisher 100 is connected to a lateral part of the copying machine main body 600.

The copying machine main body 600 includes a sheet storage portion 602, a sheet feed portion 603 that feeds the sheet P stored in the sheet storage portion 602, and an image forming portion 604 that forms the image on the sheet P fed from the sheet feed portion 603. The copying machine main body 600 also includes a document feeder 605 that can feed a document and an image reader 606 that reads information on the document fed from the document feeder 605.

The sheet storage portion 602 includes cassettes 909*a* and 909*b* that store the sheets P therein, and the sheets P stored in the cassettes 909*a* and 909*b* are fed to the image forming portion 604 in predetermined timing by sheet feed portion 603. The image forming portion 604 includes photosensitive drums 914*a* to 914*d* that form yellow, magenta, cyan, and black toner images, and the toner images formed by the photosensitive drums 914*a* to 914*d* are transferred to the sheet P. Therefore, unfixed toner images are formed on the sheet P. Then, the unfixed toner images are fixed by a fixing device 904, and the sheet P is discharged to the finisher 100 by a discharge roller 907.

In the case of duplex printing, after the sheet P is reversed by a reversing roller 905, the reversed sheet P is conveyed to the image forming portion 604 again by conveying rollers 906*a* to 906*f* provided in a reversal conveying route, and the above operation is repeated. In the case that document information is formed as image information on the sheet P, a toner image of the document information, which is fed from the document feeder 605 and read by the image reader 606, is formed on the photosensitive drums 914*a* to 914*d* and transferred to the sheet P, and then the toner image is fixed.

The finisher 100 is connected onto a downstream side of the copying machine main body 600. The plural sheets P sent from the copying machine main body 600 are introduced to the finisher 100, and the finisher 100 can perform a saddle process to the sheets P. An inserter 900 that can insert the sheet P into a conveying path 109 of the finisher 100 is provided in an upper part of the finisher 100. For example, the inserter 900 inserts an insert sheet to a front page and a final page of the sheet bundle or between the sheets, in which the images are formed by the machine main body 600.

As illustrated in FIG. 2, the sheet P sent from the copying machine main body 600 is delivered to a pair of entrance rollers 102 of the finisher 100. At the same time, an entrance sensor 101 detects delivery timing of the sheet P. When the sheet P conveyed by the pair of entrance rollers 102 passes through a conveying path 103, a lateral registration sensor 104 detects a position of an end part of the sheet P. The lateral registration sensor 104 detects how much a lateral registration error (position deviation in a width direction) X of the sheet P is generated with respect to a center position.

When the lateral registration sensor 104 detects the lateral registration error X, a shift unit 108 that is of the shift processing portion performs a shift operation, which is of the sort process of moving the sheet P in the width direction by a predetermined amount, to the sheet P on a way to a pair of shift rollers 105 and 106. The description of a lateral registration detecting process performed by the shift unit 108 is not given.

When the shift unit 108 ends the shift operation, the sheet P is conveyed by a pair of conveying rollers 110 to a downstream side of a pair of buffer rollers 115. At this point, in the case that the sheet P is discharged to an upper stack tray 136, a driving portion, such as a solenoid (not illustrated), moves an upper path switching member 118 to a position indicated by a broken line in FIG. 2. Therefore, the sheet P is guided to an upper path conveying route, and discharged to the upper stack tray 136 by a pair of upper discharge rollers 120.

On the other hand, in the case that the sheet P is not discharged to the upper stack tray 136, the upper path switching member 118 moves to a position indicated by a solid line in FIG. 2. Therefore, the sheet P is guided to a bundle conveying path 121, and moved in the bundle conveying path 121 by a pair of buffer rollers 122 and a pair of bundle conveying rollers 124.

At this point, a saddle stitching process (saddle process) is performed to the sheet P, the driving portion, such as the solenoid (not illustrated), moves a saddle path switching member 125 to a position indicated by a broken line in FIG. 2. Therefore, the sheet P is conveyed to a saddle path 133 and guided to a saddle unit 135 by a pair of saddle entrance rollers 134, and the saddle stitching process is performed to the sheet P. The description of the saddle stitching process is not given.

On the other hand, in the case that the saddle stitching process is not performed, the saddle path switching member 125 is moved to a position indicated by a solid line in FIG. 2. Therefore, the sheet P is sequentially conveyed onto an intermediate process tray 138 of a stapling portion 127 (see FIG. 3A). After an aligning process is performed in the discharge direction and the width direction to the sheet P conveyed onto the intermediate process tray 138, a stapler 132 performs a binding process to the sheet P.

The stapling portion 127 will briefly be described with reference to FIGS. 3A and 3B. The intermediate process tray 138 is obliquely disposed such that the downstream side (the left in FIG. 3) of the intermediate process tray 138 is located above with respect to the discharge direction of the sheet P while the upstream side (the right in FIG. 3) is located below. A rear end stopper 150 is provided in a lower end part that is of the upstream side of the intermediate process tray 138. A pull-in paddle 131 and an upper opening and closing guide 149 are disposed in an upper end part that is of a downstream end of the discharge direction of the intermediate process tray 138. The pull-in paddle 131 is disposed above the intermediate process tray 138, and rotated counterclockwise in FIG. 3 in proper timing by a return-paddle motor M3.

The upper opening and closing guide 149 is supported so as to be vertically rotatable about a support shaft 154. The upper opening and closing guide 149 acts as an upper conveying guide located opposite the intermediate process tray 138. The upper opening and closing guide 149 rotatably retains an upper bundle discharge roller 130*b*. The upper bundle discharge roller 130*b* and a lower bundle discharge roller 130*a*, which is provided in an end part on the downstream side of the intermediate process tray 138, constitute a pair of bundle discharge rollers 130 that are of the discharge portion. That is, the upper bundle discharge roller 130*b* is configured to be able to be brought into contact with and separated from the lower bundle discharge roller 130*a* according to the rotation of the upper opening and closing guide 149, and the upper opening and closing guide 149 is configured to be able to discharge the sheet bundle to the outside of the apparatus and to be able to open and close the pair of bundle discharge rollers 130.

When the sheet P is conveyed onto the intermediate process tray 138, usually the upper opening and closing guide 149 rotates upward to become an opened state in which the upper bundle discharge roller 130*b* is separated from the lower bundle discharge roller 130*a*. When the process of the sheet P is ended on the intermediate process tray 138, the upper opening and closing guide 149 rotates downward by driving an upper-opening-and-closing-guide motor M6, whereby the sheet bundle is nipped between upper bundle discharge roller 130*b* and the lower bundle discharge roller 130*a*. In the embodiment, the pair of bundle discharge rollers 130 (for example, lower bundle discharge roller 130*a*) is normally and reversely rotated by a bundle discharge motor M5.

A lateral end regulating portion (not illustrated), which regulates (aligns) positions at both lateral ends in the width direction of the sheet P discharged to the intermediate process tray 138, is provided in an intermediate part of the intermediate process tray 138. The lateral end regulating portion transmits drive of each of a front-aligning-plate motor M1 and a back-aligning-plate motor M2 to a front and back aligning plates (not illustrated), abuts on both the lateral ends of the sheet P stacked on the intermediate process tray 138, and aligns the sheet P in the width direction. The stapling portion 127 includes a sheet-rear-end aligning portion that aligns the position of the rear end in the discharge direction of the sheet P, and the sheet-rear-end aligning portion includes the pull-in paddle 131, a belt roller 158, a rear-end lever 159, and a rear-end stopper 150. By the counterclockwise rotations of the pull-in paddle 131 and the belt roller 158, the upstream end in the width direction of the sheet P is abutted on the rear-end stopper 150 while the sheet P conveyed onto the intermediate process tray 138 is guided by the rear-end lever 159, thereby aligning the rear-end position in the discharge direction of the sheet P.

The sheet P, to which a predetermined sheet process is performed by the stapling portion 127, is discharged to a lower stack tray 137 that is of the sheet stacking portion by the pair of bundle discharge rollers 130. On the other hand, when the sheet P to which the predetermined sheet process is performed by the stapling portion 127, as illustrated in FIG. 3B, the sheet P is delivered from a pair of lower discharge rollers 128 to the pair of bundle discharge rollers 130, and discharged to the lower stack tray 137. Then a width-direction aligning portion 200 and a discharge-direction aligning portion 300, which are of the sheet aligning portion, aligns the sheet P discharged to the lower stack tray 137 in the width direction and the discharge direction on the lower stack tray 137. The width-direction aligning process performed by the width-direction aligning portion 200 and the discharge-direction aligning process performed by the discharge-direction aligning portion 300 are described later.

Figure 4:
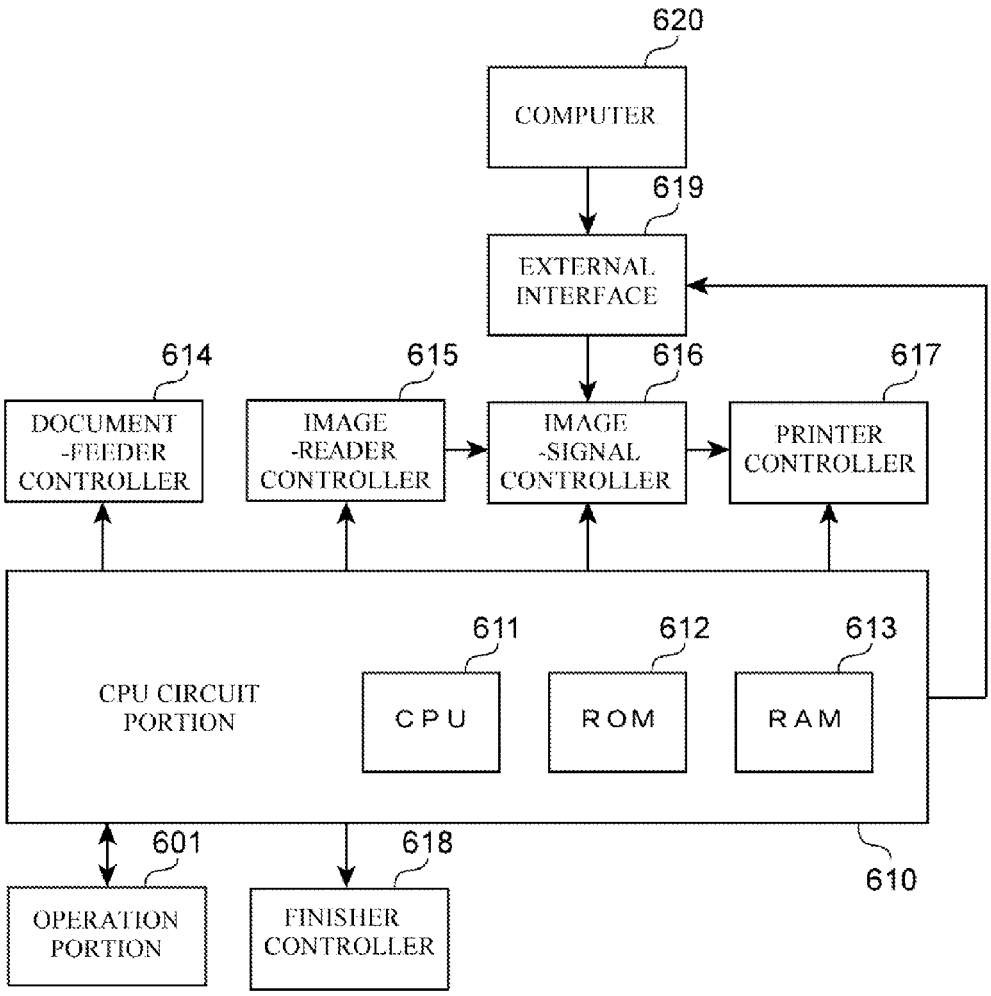
FIG. 4 is a block diagram of a CPU circuit portion that controls the copying machine of the embodiment.
Figure 5:
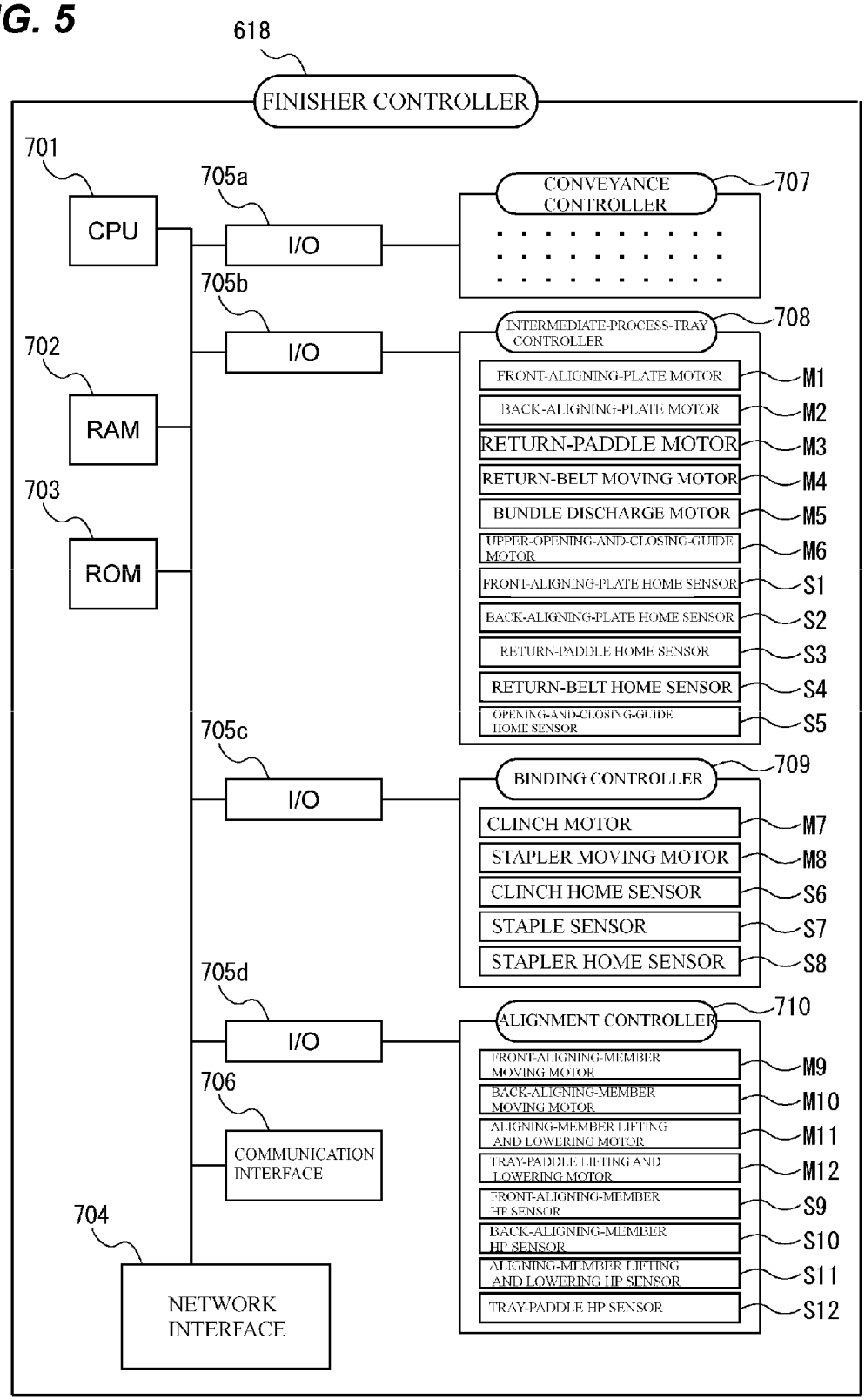
FIG. 5 is a block diagram of a finisher controller of the embodiment.

A CPU circuit portion 610 that controls the copying machine 1000 will be described with reference to FIGS. 4 and 5. FIG. 4 is a block diagram of the CPU circuit portion 610 that controls the copying machine 1000. FIG. 5 is a block diagram of a finisher controller 618 of the embodiment.

As illustrated in FIG. 4, the CPU circuit portion 610 includes a CPU 611, a ROM 612, and a RAM 613. The CPU 611 controls a document feeder controller 614, an image-reader controller 615, an image-signal controller 616, a printer controller 617, the finisher controller 618, and the like according to a program stored in the ROM 612 and instruction information input from an operation portion 601. The RAM 613 is used as an area where control data is tentatively retained or a work area of a computation associated with the control.

The document feeder controller 614 controls the document feeder 605, and the image-reader controller 615 controls the image reader 606 that reads the information on the document fed from the document feeder 605 (see FIG. 1). The image-reader controller 615 outputs the read document data to the image-signal controller 616. The printer controller 617 controls the copying machine main body 600. An external interface 619 is one that connects an external computer 620 and the copying machine main body 600. For example, print data input from the external computer 620 is expanded into the image, and output to the image-signal controller 616. The image output to the image-signal controller 616 is output to the printer controller 617, and the image is formed by the image forming portion 604.

As illustrated in FIG. 5, the finisher controller 618 includes a CPU (microcomputer) 701, a RAM 702, a ROM 703, input/output portions (I/O) 705*a* to 705*d*, a communication interface 706, and a network interface 704. The finisher controller 618 also includes a conveyance controller 707, an intermediate-process-tray controller 708, a binding controller 709, and an alignment controller 710.

The conveyance controller 707 controls the lateral registration sensing process of the sheet, buffering process of the sheet P, the conveying process of the sheet P, and the like. The intermediate-process-tray controller 708 performs operation control of the lateral-end regulating portion disposed in the intermediate process tray 138, rotating operation control of the pull-in paddle 131, moving operation control of the belt roller 158, and opening and closing control of the upper opening and closing guide 149. For example, the operation control of the lateral-end regulating portion is performed such that the front-aligning-plate motor M1 and the back-aligning-plate motor M2 are controlled based on a front-aligning-plate home sensor S1 and a back-aligning-plate home sensor S2. For example, the rotating operation control of the pull-in paddle 131 is performed such that the rotation of the return-paddle motor M3 is controlled based on a return-paddle home sensor S3. For example, the moving operation control of the belt roller 158 is performed such that a return-belt moving motor M4 is controlled based on a return-belt home sensor S4. For example, the opening and closing control of the upper opening and closing guide 149 is performed such that the upper-opening-and-closing-guide motor M6 is controlled based on an opening-and-closing-guide home sensor S5.

The binding controller 709 controls clinch, movement, and the like of the stapler 132, which are performed such that a clinch motor M7 and a stapler moving motor M8 are controlled based on a clinch home sensor S6, a staple sensor S7, and a stapler home sensor S8.

The alignment controller 710 that is of the controller controls the movements of aligning members 1 and 1, the lifting and lowering of a return holder 50, and the like using a home position sensor and a moving motor. The aligning members 1 and 1 are controlled by controlling such that a front-aligning-member moving motor M9, a back-aligning-member moving motor M10, and a aligning-member lifting and lowering motor M11 are controlled based on a front-aligning-member HP sensor S9, a back-aligning-member HP sensor S10, and an aligning-member lifting and lowering HP sensor S11. The return holder 50 is controlled such that rotating of a tray-paddle lifting and lowering motor M12 is controlled based on a tray paddle HP sensor S12. The configuration, in which the alignment controller 710 controls the movements of the aligning members 1 and 1 and the lifting and lowering of the return holder 50, is described in the embodiment. Alternatively, the alignment controller may be provided in the CPU circuit portion 610 on the side of the copying machine 1000 to directly control the movements of the aligning members 1 and 1 and the lifting and lowering of the return holder 50 from the side of the copying machine 1000.

Various sensor signals of the above-described controllers of the finisher controller 618 are input to input ports of the input/output portions (I/O) 705*a* to 705*d*, and signals are output from output ports of the input/output portions (I/O) 705*a* to 705*d* to the above-described driving systems connected via a control block and various drivers (not illustrated).

Figure 6A:
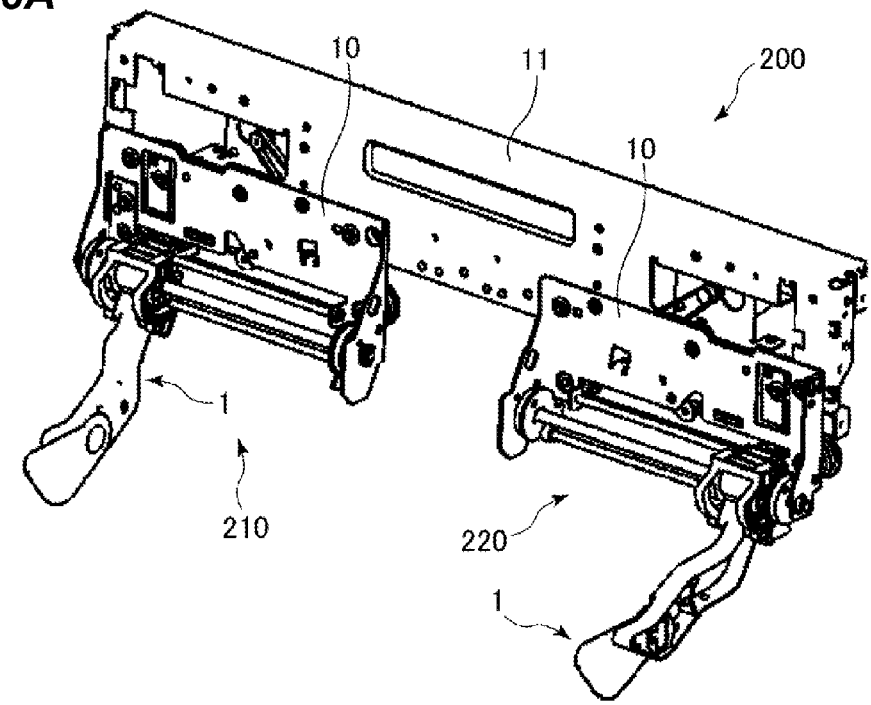
FIG. 6A is a perspective view of a width-direction aligning portion when viewed from one side.
Figure 6B:
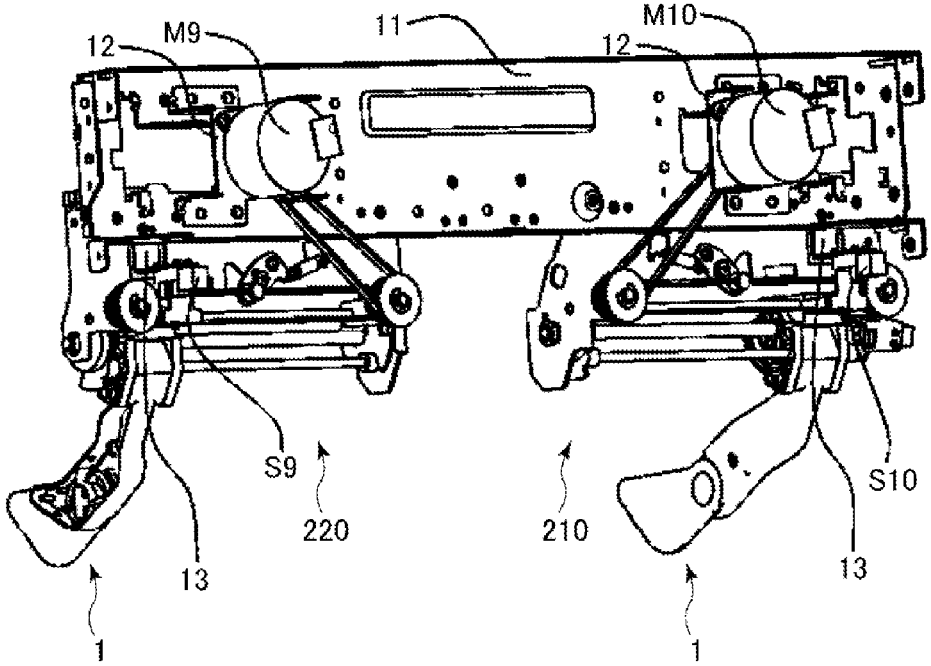
FIG. 6B is a perspective view of the width-direction aligning portion when viewed from the other side.
Figure 7A:
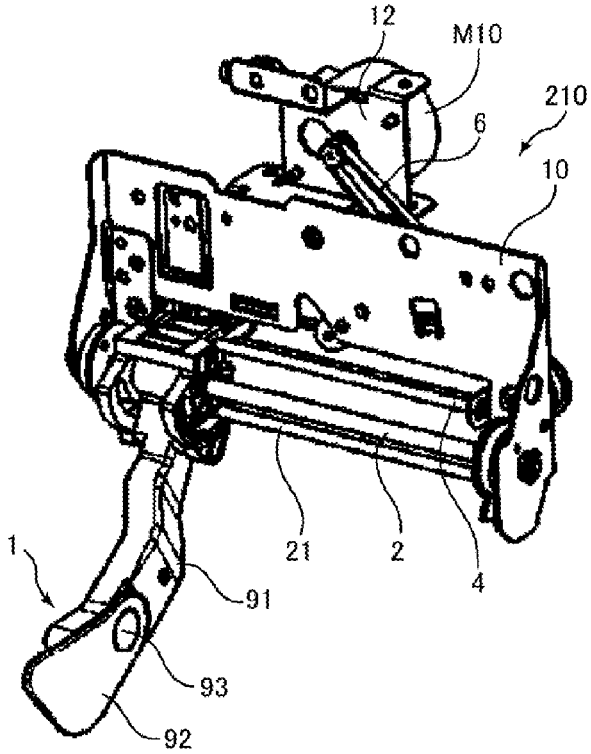
FIG. 7A is a perspective view of a back aligning unit when viewed from one side.
Figure 7B:
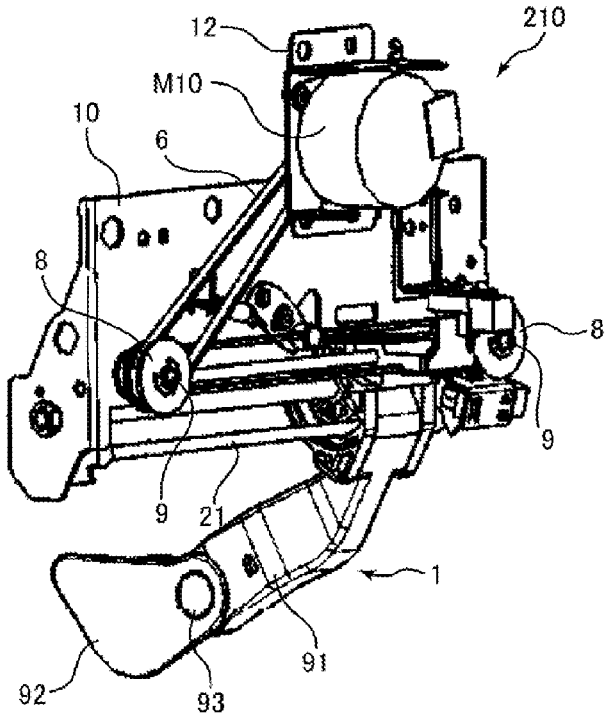
FIG. 7B is a perspective view of the back aligning unit when viewed from the other side.
Figure 8A:
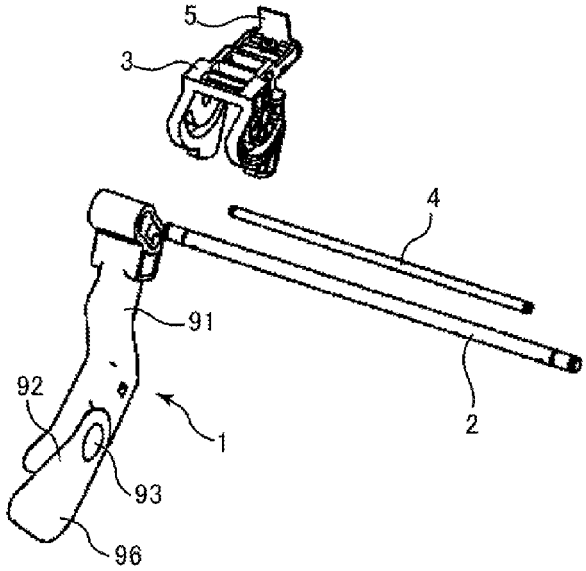
FIG. 8A is an exploded perspective view illustrating an aligning member and the like of the back aligning unit.
Figure 8B:
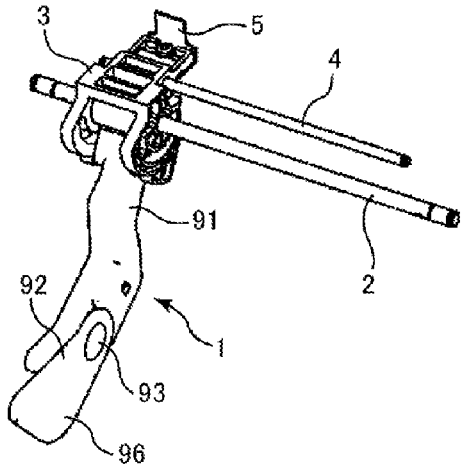
FIG. 8B is a perspective view of the aligning member and the like of the back aligning unit when viewed from one side.
Figure 8C:
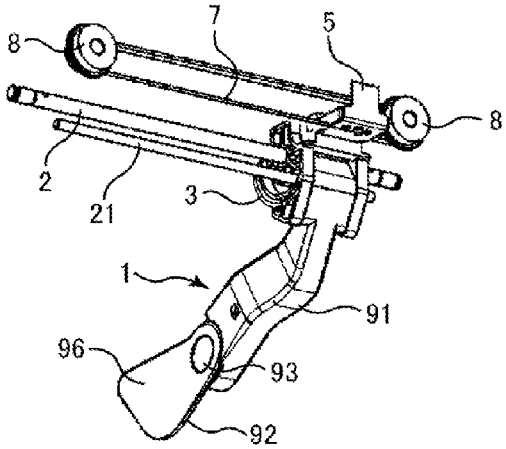
FIG. 8C is a perspective view of the aligning member and the like of the back aligning unit.
Figure 9A:
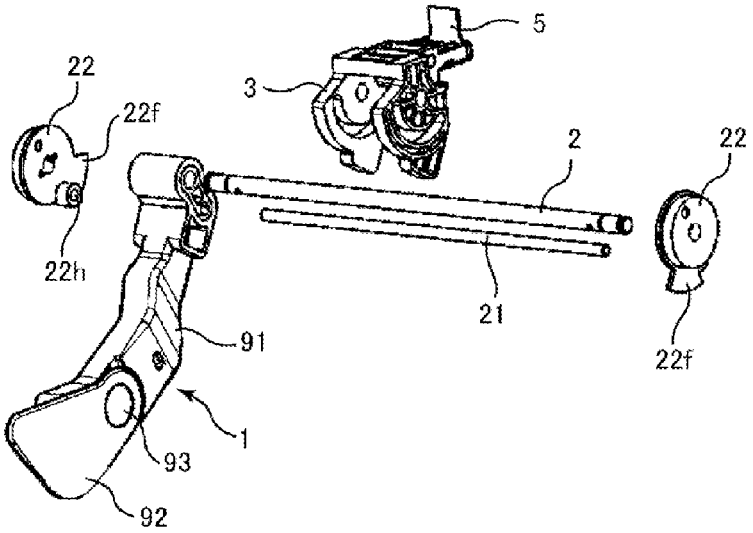
FIG. 9A is an exploded perspective view illustrating the aligning member and the like of the back aligning unit.
Figure 9B:
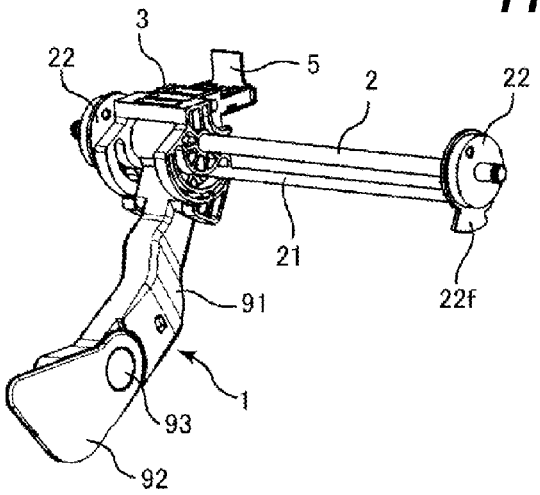
FIG. 9B is a perspective view of the aligning member and the like of the back aligning unit when viewed from one side.
Figure 9C:
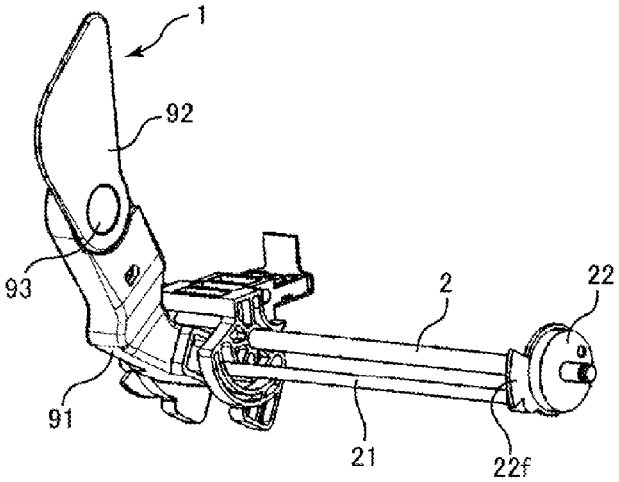
FIG. 9C is a perspective view illustrating a state in which the aligning member of the back aligning unit rotates.
Figure 10A:
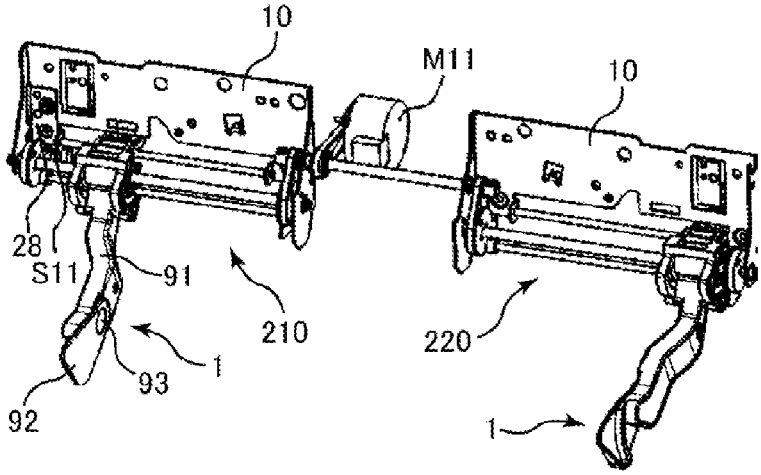
FIG. 10A is a perspective view illustrating a state in which a front aligning unit and the back aligning unit are coupled.
Figure 10B:
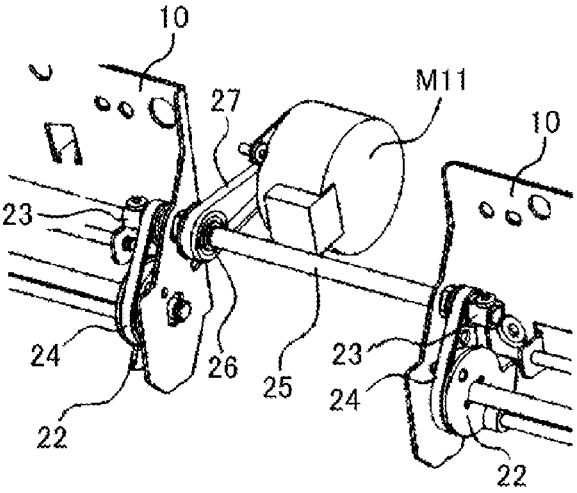
FIG. 10B is a partially enlarged view illustrating an aligning-member lifting and lowering motor that lifts and lowers the aligning member.
Figure 10C:
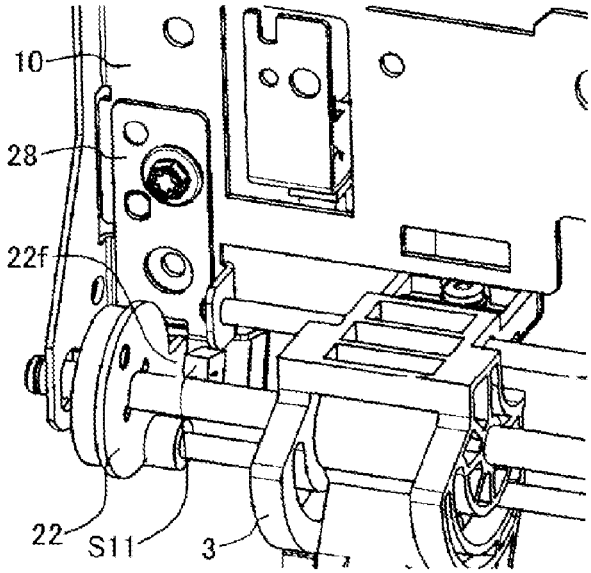
FIG. 10C is a partially enlarged view illustrating an aligning member lifting and lowering HP sensor that detects a lifting and lowering position of the aligning member.

The width-direction aligning portion 200 that performs the aligning process in the width direction orthogonal to the discharge direction of the sheet discharged to the lower stack tray 137 will be described with reference to FIG. 2 and FIGS. 6A to 10C. FIG. 6A is a perspective view of the width-direction aligning portion 200 when viewed from one side. FIG. 6B is a perspective view of the width-direction aligning portion 200 when viewed from the other side. FIG. 7A is a perspective view of a back aligning unit 210 when viewed from one side. FIG. 7B is a perspective view of the back aligning unit 210 when viewed from the other side. FIG. 8A is an exploded perspective view illustrating an aligning member 1 and the like of the back aligning unit 210. FIG. 8B is a perspective view of the aligning member 1 and the like of the back aligning unit 210 when viewed from one side. FIG. 8C is a perspective view of the aligning member 1 and the like of the back aligning unit 210. FIG. 9A is an exploded perspective view illustrating the aligning member 1 and the like of the back aligning unit 210. FIG. 9B is a perspective view of the aligning member 1 and the like of the back aligning unit 210 when viewed from one side. FIG. 9C is a perspective view illustrating a state in which the aligning member 1 of the back aligning unit 210 rotates upward. FIG. 10A is a perspective view illustrating a state in which a front aligning unit 220 and the back aligning unit 210 are coupled. FIG. 10B is a partially enlarged view illustrating the aligning-member lifting and lowering motor M11 that lifts and lowers the aligning member 1. FIG. 10C is a partially enlarged view illustrating the aligning member lifting and lowering HP sensor S11 that detects a lifting and lowering position of the aligning member 1.

As illustrated in FIG. 2, the width-direction aligning portion 200 is provided above the lower stack tray 137. As illustrated in FIGS. 6A and 6B, the width-direction aligning portion 200 includes the front aligning unit 220 disposed on the front side, the back aligning unit 210 disposed on the back side, and an upper stay 11. The front aligning unit 220 and the back aligning unit 210 are symmetrically attached with respect to the upper stay 11. Because the front aligning unit 220 and the back aligning unit 210 have the same basic configuration, only the configuration of the back aligning unit 210 will be described while the description of the configuration of the front aligning unit 220 is not given.

As illustrated in FIGS. 7A and 7B, the back aligning unit 210 includes a pair of arm-shape aligning members 1, a pulley support plate 10, and the back-aligning-member moving motor M10 (front-aligning-member moving motor M9) that is of the driving portion. The aligning member 1 includes a first aligning member 91 that is of the pair of aligning arms and a second aligning member 92 that is of the pair of aligning members. The first aligning member 91 is vertically rotatable with a first aligning support shaft 2, which is provided above the lower stack tray 137, as a rotating center. The second aligning member 92 is supported at a leading end of the first aligning member 91 in a vertically rotatable manner. As illustrated in FIGS. 8A and 8B, a base end of the first aligning member 91 is supported by a moving member 3 that is movably supported by the first aligning support shaft 2, and the first aligning member 91 is configured to move in a front-back direction (width direction) such that the moving member 3 moves along the first aligning support shaft 2. The moving member 3 is rotatably and movably supported with the first aligning support shaft 2 as the rotating center. The moving member 3 is supported as a rotation stopper by a second aligning support shaft 4.

As illustrated in FIG. 8C, the moving member 3 and a position sensing member 5 nip a second drive transmission belt 7, and the second drive transmission belt 7 is entrained about drive transmission pulleys 8 and 8. The drive transmission pulleys 8 and 8 are rotatably supported by a pulley support shaft 9 swaged in pulley support plate 10. The drive transmission pulleys 8 and 8 are formed as a stepped pulley to engage the first drive transmission belt 6. The first drive transmission belt 6 engages the back-aligning-member moving motor M10. The drive of the back-aligning-member moving motor M10 is transmitted to the first aligning member 91 through the first drive transmission belt 6, the drive transmission pulley 8, the second drive transmission belt 7, and the moving member 3, and the first aligning member 91 moves in the front-back direction along the first aligning support shaft 2.

As illustrated in FIGS. 9A and 9B, the first aligning member 91 engages a third aligning support shaft 21 that is of the rotation stopper, and both ends of the third aligning support shaft 21 are supported by aligning-member lifting and lowering pulleys 22 and 22 supported by the first aligning support shaft 2. Because the first aligning support shaft 2 and the aligning-member lifting and lowering pulleys 22 and 22 are engaged by a parallel pin, the aligning-member lifting and lowering pulley 22 and the aligning-member lifting and lowering pulley 22 rotate synchronously. Therefore, as illustrated in FIG. 9C, when the aligning-member lifting and lowering pulleys 22 and 22 rotate, the third aligning support shaft 21 rotates about the first aligning support shaft 2, thereby rotating the engaged aligning member 1.

As illustrated in FIGS. 10A to 10C, the aligning-member lifting and lowering pulley 22 is coupled to a second lifting and lowering pulley 23 with the drive transmission belt 24 interposed therebetween, and the front side and the back side of the second lifting and lowering pulley 23 are attached to a lifting and lowering transmission shaft 25 in a D-cut manner. A third lifting and lowering pulley 26 engages the lifting and lowering transmission shaft 25, and the third lifting and lowering pulley 26 is coupled to the aligning-member lifting and lowering motor M11 that is of the driving portion with a drive transmission belt 27 interposed therebetween. Therefore, the drive of the aligning-member lifting and lowering motor M11 is transmitted to the third lifting and lowering pulley 26 through the drive transmission belt 27, and transmitted to the aligning-member lifting and lowering pulley 22 through the lifting and lowering transmission shaft 25, the second lifting and lowering pulley 23, and the drive transmission belt 24. As a result, the aligning-member lifting and lowering pulley 22 rotates, and the first aligning member 91 rotates vertically through the third aligning support shaft 21. That is, the aligning member 1 is lifted and lowered.

At this point, a flag portion 22*f* included in the aligning-member lifting and lowering pulley 22 rotates on and off the aligning-member lifting and lowering HP sensor S11 that detects the lifting and lowering position of the aligning member 1, thereby detecting and controlling the rotating position of the first aligning member 91. The drive of the aligning-member lifting and lowering motor M11 is transmitted to the lifting and lowering of the first aligning members 91 and 91 of the front aligning unit 220 and the back aligning unit 210, and the rotations and positions of the first aligning members 91 and 91 are controlled while synchronized with the lifting and lowering (rotation).

The second aligning member 92 is supported while being vertically rotatable (bendable) about a rotating shaft 93, which is of the rotating center, with respect to the first aligning member 91, and the second aligning member 92 includes an alignment surface 96 that presses an end part of the sheet P. A lower part of the second aligning member 92 constitutes a ridge line 94 (see FIG. 20A). The ridge line 94 is formed in substantially parallel to a depression 97 that is of a recess formed in a stacking surface of a lower stack tray 137, and the ridge line 94 is movable along the depression 97. When the second aligning member 92 abuts on the previously-stacked sheet, the ridge line 94 is formed into a shape, in which the ridge line 94 rotates upward about the rotating shaft 93 while the abutment state is maintained (see FIG. 20B).

As illustrated in FIGS. 11A to 11D, a groove 92*m* that nips a leading-end part 91*t* of the first aligning member 91 may be provided in the second aligning member 92. The groove 92*m* nips the leading-end part 91*t* of the first aligning member 91 to remove looseness between the first aligning member 91 and the second aligning member 92, so that followability of the second aligning member 92 can be improved when the first aligning member 91 moves to align the sheet. The groove 92*m* is formed so as to be able to guide the leading-end part 91*t* along a rotating locus when the second aligning member 92 rotates about the rotating shaft 93. Anywhere the second aligning member 92 rotates, the groove 92*m* can remove the looseness to maintain the followability to the movement of the first aligning member 91.

Figure 11A:
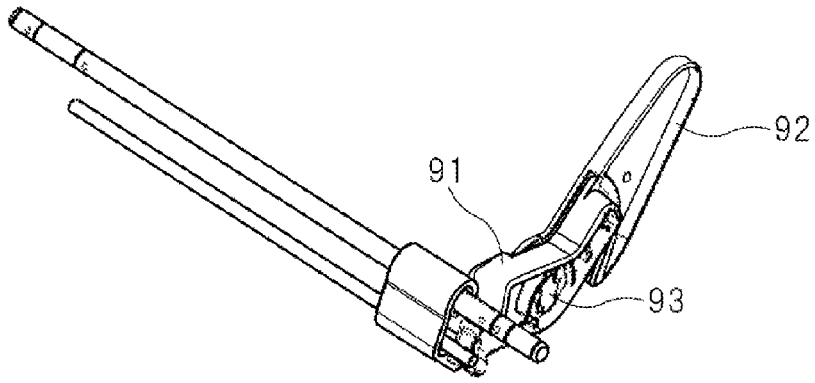
FIGS. 11A to 11D are views illustrating placements of a first aligning member and a groove of a second aligning member.
Figure 11B:
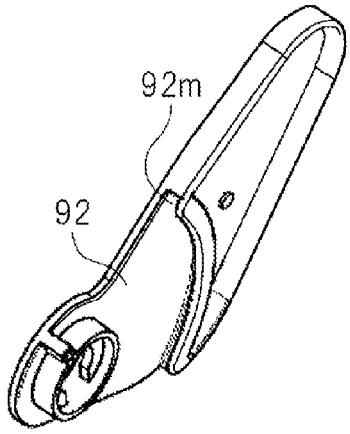
Figure 11C:
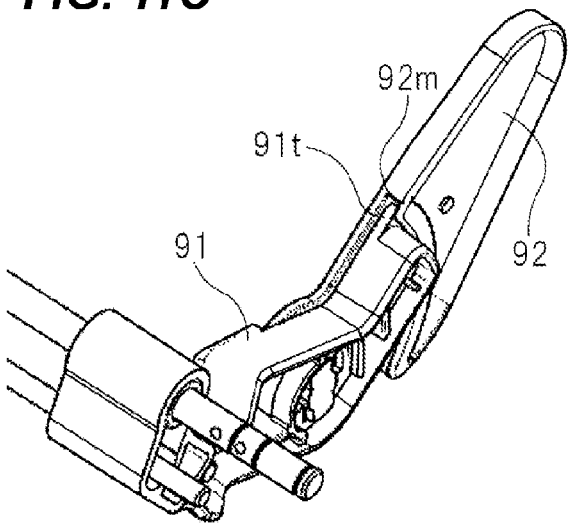
Figure 11D:
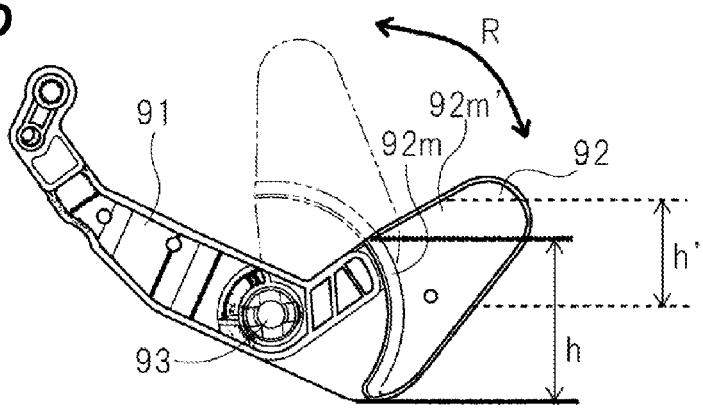

The groove 92*m* is disposed in a wide region in the vertical direction of the second aligning member 92 in order that a vertical rotating region is widened when the second aligning member 92 rotates in a direction of an arrow R in FIG. 11D.

For example, when the groove 92*m* is disposed in a dotted-line position 92*m*', a rotating region height is narrowed from h to h'. Possibly a lap amount between the recess of the lower stack tray 137 and the second aligning member 92 can insufficiently be ensured, and sometimes a stack deviation is generated by a non-contact of the second aligning member 92 with the sheet depending on a curl state of the sheet. Therefore, the generation of the stack deviation can be prevented by widening the rotating region of the second aligning member 92.

Figure 12:
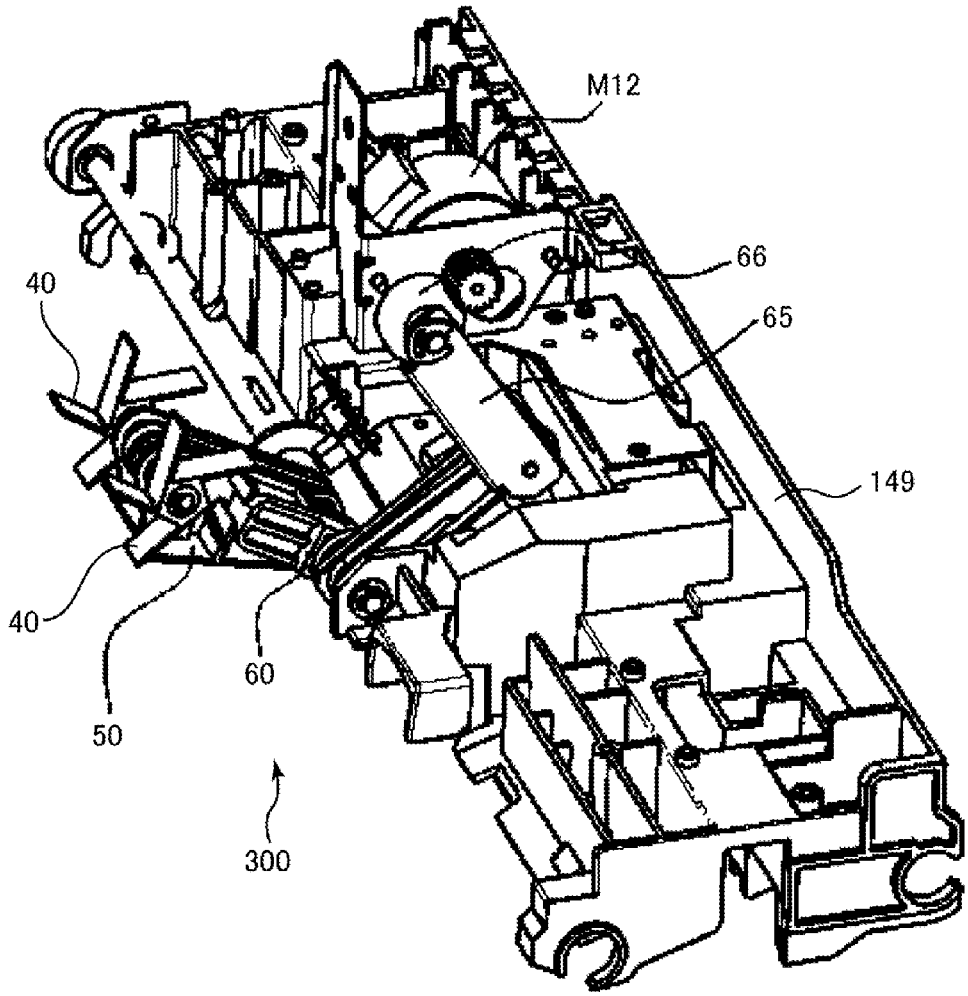
FIG. 12 is a perspective view illustrating a discharge-direction aligning portion supported by an upper opening and closing guide.
Figure 13A:
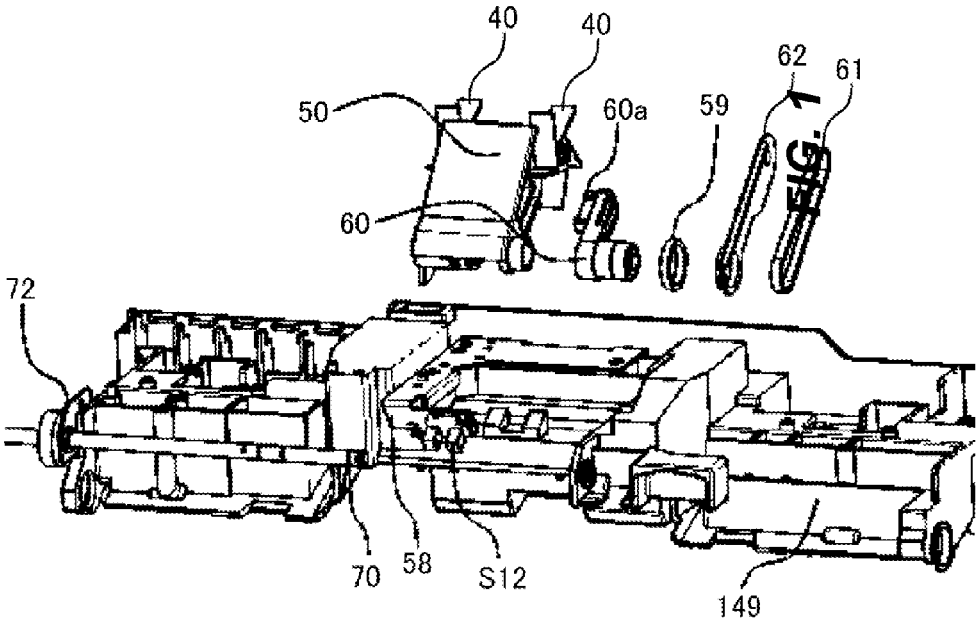
FIG. 13A is an exploded perspective view of the discharge-direction aligning portion.
Figure 13B:
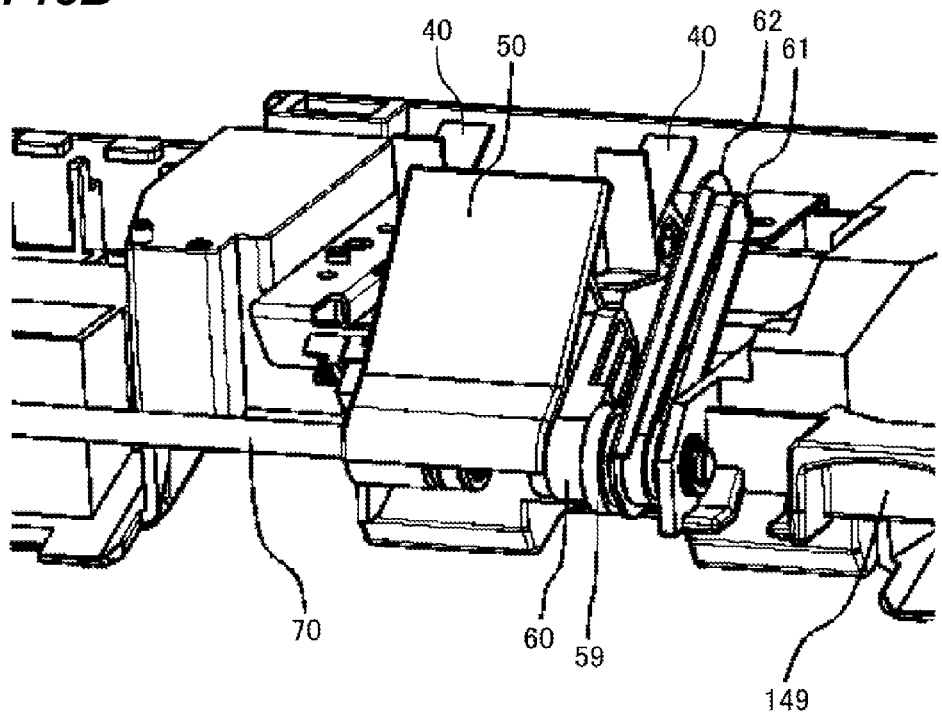
FIG. 13B is a partially enlarged view of the discharge-direction aligning portion located in a retracting position.
Figure 14A:
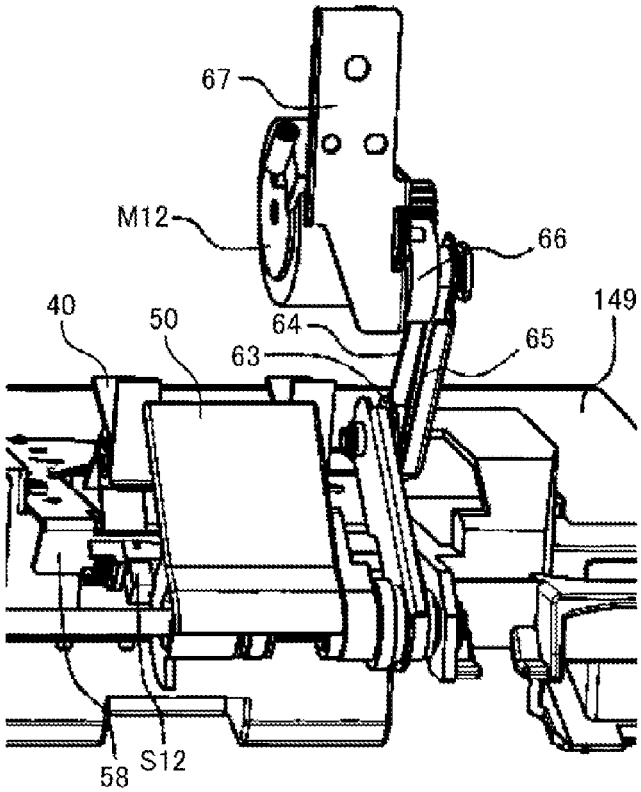
FIG. 14A is a view illustrating a lifting-and-lowering-motor support plate that is used to attach the discharge-direction aligning portion to an upper stay.
Figure 14B:
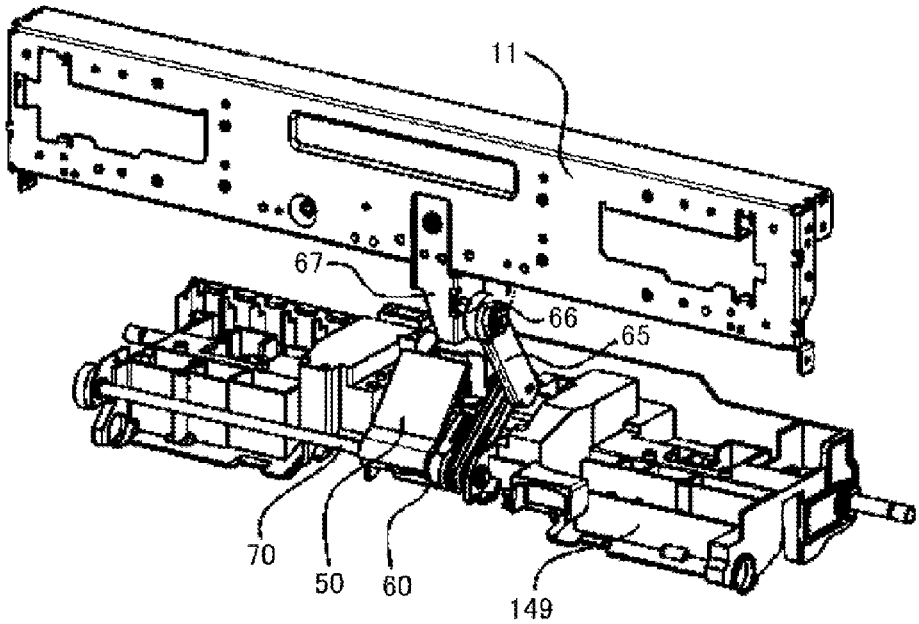
FIG. 14B is a perspective view illustrating the discharge-direction aligning portion attached to the upper stay.
Figure 15A:
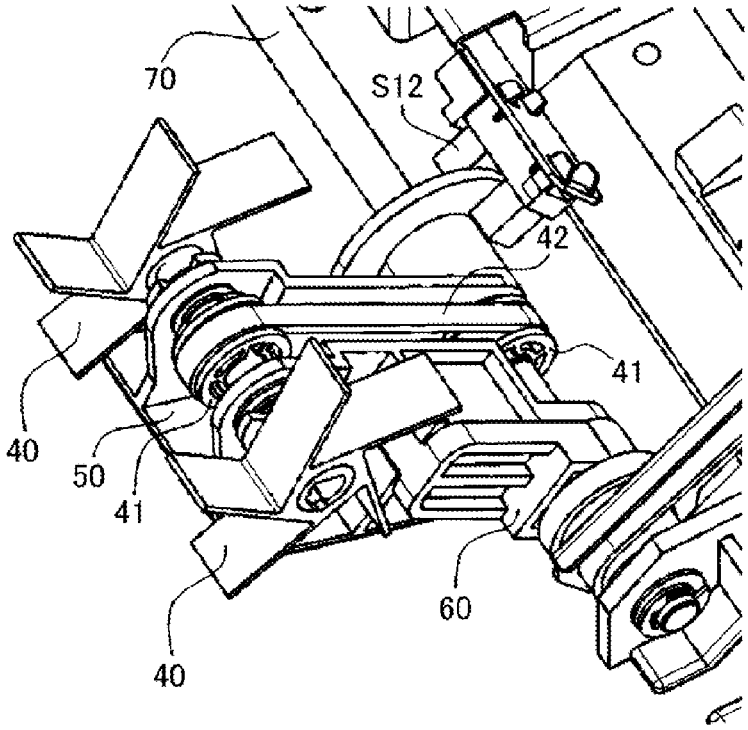
FIG. 15A is a view illustrating a tray paddle and the like, which are supported by a return holder.
Figure 15B:
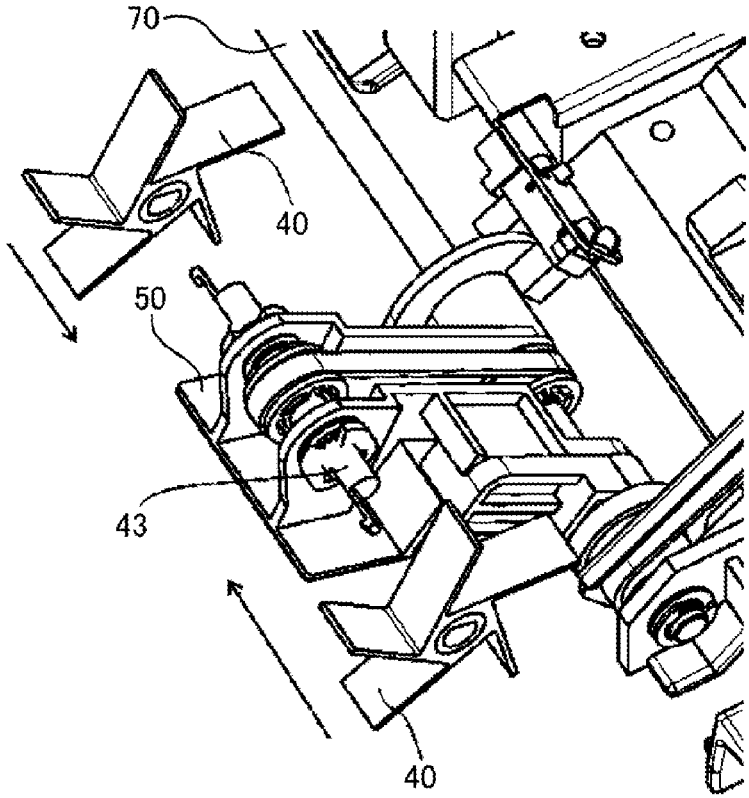
FIG. 15B is an exploded perspective view of FIG. 15A.
Figure 16A:
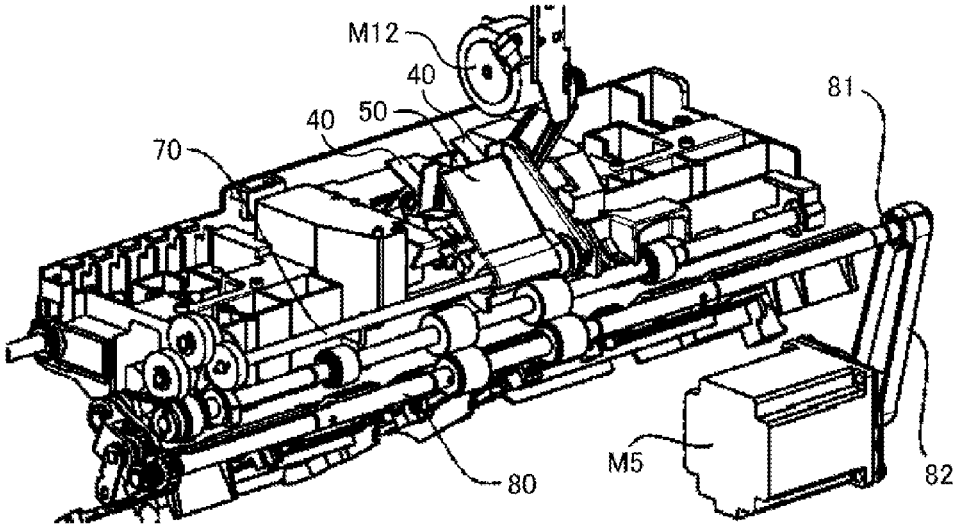
FIG. 16A is a perspective view illustrating the discharge-direction aligning portion connected to a bundle discharge motor.
Figure 16B:
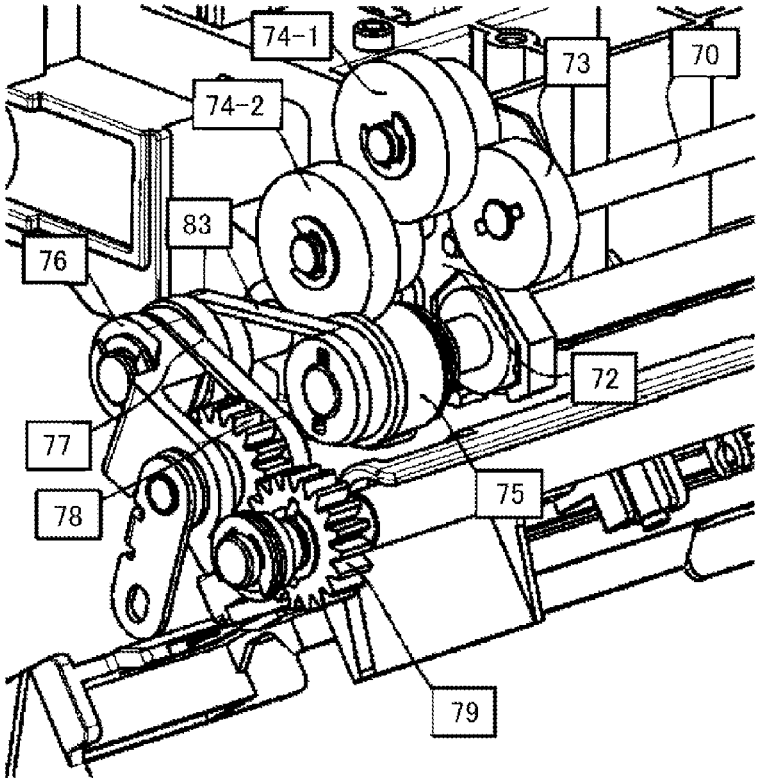
FIG. 16B is a partially enlarged view illustrating a gear train of FIG. 15A.

The discharge-direction aligning portion 300 that aligns the sheet discharged to the lower stack tray 137 in the discharge direction will be described below with reference to FIGS. 12 to 16B. FIG. 12 is a perspective view illustrating the discharge-direction aligning portion 300 supported by the upper opening and closing guide 149. FIG. 13A is an exploded perspective view of the discharge-direction aligning portion 300, and FIG. 13B is a partially enlarged view of the discharge-direction aligning portion 300 located in a retracting position. FIG. 14A is a view illustrating a lifting-and-lowering-motor support plate 67 that is used to attach the discharge-direction aligning portion 300 to the upper stay 11, and FIG. 14B is a perspective view illustrating the discharge-direction aligning portion 300 attached to the upper stay 11. FIG. 15A is a view illustrating a tray paddle 40 and the like, which are supported by the return holder 50, and FIG. 15B is an exploded perspective view of FIG. 15A. FIG. 16A is a perspective view illustrating the discharge-direction aligning portion 300 connected to a bundle discharge motor M5, and FIG. 16B is a partially enlarged view illustrating a gear train of FIG. 16A.

As illustrated in FIG. 12, the discharge-direction aligning portion 300 is supported in a substantial central part in the front-back direction of the upper opening and closing guide 149, and supported above the upper bundle discharge roller 130*b*, whereby the discharge-direction aligning portion 300 is located above the sheet P discharged from the intermediate process tray 138. As illustrated in FIGS. 13A and 13B, the discharge-direction aligning portion 300 includes the tray paddles 40 and 40 and the return holder 50. The tray paddles 40 and 40 is rotatably supported in a leading-end part of the return holder 50, and a base end of the return holder 50 is supported by a tray returning support shaft 70. The tray returning support shaft 70 is rotatably supported by the upper opening and closing guide 149 so as to be located above the upper bundle discharge roller 130*b*. Therefore, the return holder 50 rotates above the upper bundle discharge roller 130*b*. One end (back side) of the tray returning support shaft 70 is supported by the upper opening and closing guide 149 with a gear support plate 72 interposed therebetween.

The other end (front side) of the tray returning support shaft 70 is connected to a return-member lifting and lowering pulley 60, in which a leading end 60*a* is fitted in the return holder 50, such that the rotation of the return holder 50 is synchronized with the rotation of the tray returning support shaft 70. As illustrated in FIGS. 14A and 14B, a drive transmission belt 61 and a first lifting and lowering link 62 are connected to the return-member lifting and lowering pulley 60 with the lifting-and-lowering-pulley spacer 59 interposed therebetween, and the drive transmission belt 61 and the first lifting and lowering link 62 are connected to a lifting-and-lowering-link pulley 63. The lifting-and-lowering-link pulley 63 is connected to the tray-paddle lifting and lowering motor M12 while a drive transmission belt 64 and a lifting and lowering link gear 66 are interposed between the lifting-and-lowering-link pulley 63 and the tray-paddle lifting and lowering motor M12. A second lifting and lowering link 65 is attached to the drive transmission belt 64 in order to keep a distance between axes of the drive transmission belt 64. The tray-paddle lifting and lowering motor M12 is attached to a lifting-and-lowering-motor support plate 67, and the lifting-and-lowering-motor support plate 67 is attached to the upper stay 11. Therefore, the driving force of the tray-paddle lifting and lowering motor M12 can be transmitted to the return holder 50, and the return holder 50 can rotate about the tray returning support shaft 70. That is, the tray paddle 40 supported by the leading end of the return holder 50 is movable.

The tray-paddle HP sensor S12, which is attached to the upper opening and closing guide 149 with a sensor plate 58 interposed therebetween, detects the rotating of the return holder 50, and the alignment controller 710 of the finisher controller 618 performs position control. Specifically, the movement of the return holder 50 is controlled between a standby position, in which the return holder 50 waits above the pair of bundle discharge rollers 130, and an abutment position, in which the sheet is abutted on the abutment portion 170 while the sheet is nipped between the return holder 50 and the stacking surface of the lower stack tray 137. After the aligning process (job), the return holder 50 is controlled so as to move to a retracting position in which the return holder 50 is accommodated in the upper opening and closing guide 149. The return holder 50 is configured to be usually located in the retracting position that is of a home position. The retracting position is formed in the upper opening and closing guide 149 so as not to interfere with the rotating operation of the upper opening and closing guide 149 in the finisher 100.

Each of the tray paddles 40 and 40 is formed such that plural paddles are radially fixed to the rotating shaft. As illustrated in FIGS. 15A and 15B, the tray paddles 40 and 40 are connected to both ends of a tray returning shaft 43 that is rotatably supported at the leading end of the return holder 50. The tray returning shaft 43 is connected to a tray returning pulley 41 with a drive transmission belt 42 interposed therebetween. The drive transmission belt 42 is entrained about the tray returning pulley 41 that is attached to a substantially central part of the tray returning shaft 43. The tray returning pulley 41 is attached to the other end (front side) of the tray returning support shaft 70. The tray returning shaft 43 and the tray returning pulley 41 are engaged by a parallel pin, and the tray returning support shaft 70 and the tray returning pulley 41 are also engaged by a parallel pin, so that the rotation of the tray paddle 40 is synchronized with the rotation of the tray returning support shaft 70.

As illustrated in FIGS. 16A and 16B, a gear train supported by a gear support plate 72 is connected to an end part of the tray returning support shaft 70. In the gear train, return driving gears 74-1 and 74-2, a discharge driving W-pulley 75, a discharge driving belt 83, a discharge coupling W-pulley 76, a discharge transmission belt 77, a discharge driving w-gear 78, and a discharge gear 79 are coupled from a return driving gear 73 connected to the end part of the tray returning support shaft 70.

The discharge gear 79 is connected to a discharge driving pulley 81 with the lower bundle discharge roller 130*a* of the pair of bundle discharge rollers 130 interposed therebetween, and the discharge driving pulley 81 is connected to the bundle discharge motor M5 with a drive transmission belt 82 interposed therebetween. That is, the bundle discharge motor M5 is used as a common driving source that rotates the tray paddles 40 and 40 and the lower bundle discharge roller 130*a*. The common driving source of the tray paddles 40 and 40 and the lower bundle discharge roller 130*a* can decrease the number of components.

Figure 17:
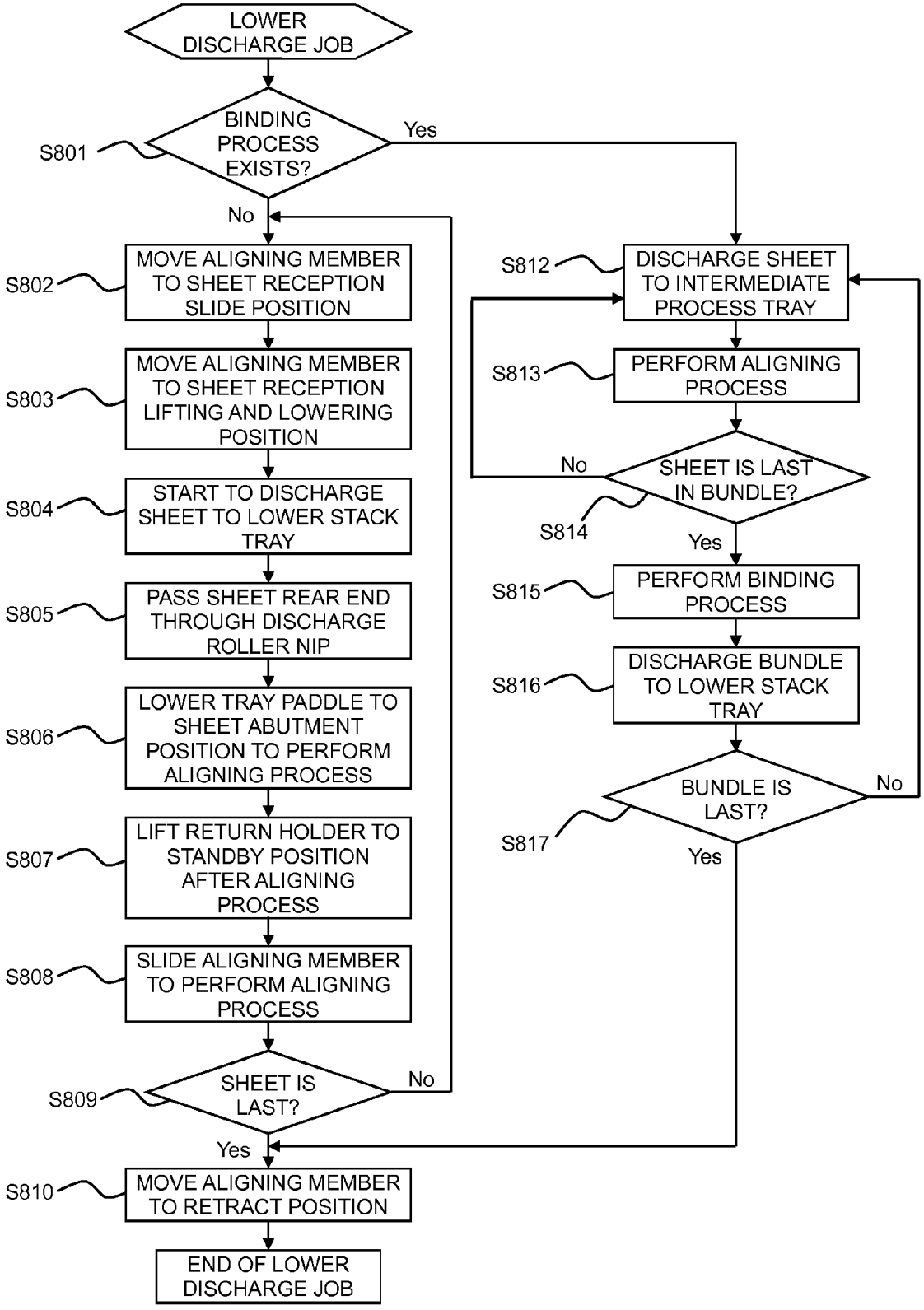
FIG. 17 is a flowchart illustrating an aligning process in an unbound process mode of the sheet discharged to the lower stack tray.

The process of aligning the sheet P on the lower stack tray 137, which is performed by the finisher controller 618 of the finisher 100 having the above configuration, will be described below with reference to FIGS. 17 to 20. The unbound process mode, which is performed when the sheet to which the stapling process is not performed is discharged onto the lower stack tray 137, will be described with reference to FIG. 17. FIG. 17 is a flowchart illustrating the aligning process in the unbound process mode of the sheet discharged to the lower stack tray 137.

As illustrated in FIG. 17, when the unbound process mode is set to start a job (S801), the alignment controller 710 performs initial operations of the aligning members 1 and 1 and the return holder 50 of the front aligning unit 220 and the back aligning unit 210 to move the aligning members 1 and 1 and the return holder 50 to the home positions. In the case that the binding process is performed, the description of the aligning process (S812 to S817) on the intermediate process tray 138 is not given.

At this point, the front-aligning-member HP sensor S9 and the back-aligning-member HP sensor S10, which are provided on the back side and front side, detect the home positions in the moving directions of the aligning members 1 and 1, and the aligning members 1 and 1 are moved when the aligning members 1 and 1 are not located in the home positions. The home positions in the moving directions of the aligning members 1 and 1 are the retracting positions in which the aligning members 1 and 1 are retracted to both ends in the front-back direction, respectively.

The aligning-member lifting and lowering HP sensor S11 detects the home positions in the lifting and lowering directions of the aligning members 1 and 1, and the aligning members 1 and 1 are moved when the aligning members 1 and 1 are not located in the home positions. The home positions in the lifting and lowering directions of the aligning members 1 and 1 are the retracting positions in which the leading ends of the aligning members 1 and 1 are retracted while rotated upward about the first aligning support shaft 2.

The tray-paddle HP sensor S12 detects the home position in the rotating direction of the return holder 50, and the return holder 50 is moved when the return holder 50 is not located in the home position. The home position of the return holder 50 is accommodated above the upper opening and closing guide 149 in the finisher 100, and the user does not contact the home position of the return holder 50. The home position of the return holder 50 is located so as not to interfere with the opening and closing operation of the upper opening and closing guide 149.

When the aligning members 1 and 1 and the return holder 50 are located in the home positions by the initial operation, the alignment controller 710 moves the aligning members 1 and 1 and the return holder 50 to the standby positions in which the sheet is received. The aligning members 1 and 1 are moved to the sheet reception positions according to input sheet size information (S802). As used herein, the reception positions of the aligning members 1 and 1 mean positions in which a gap between the aligning members 1 and 1 is larger than a length in the width direction (front-back direction) of the sheet by a predetermined amount, and positions in which the aligning members 1 and 1 do not interfere with the sheet discharged from the pair of bundle discharge rollers 130. Then the aligning members 1 and 1 are lowered from the sheet reception position by a predetermined amount, and moved to a sheet reception lifting and lowering position (hereinafter referred to as a "standby position") (S803). Similarly the return holder 50 is also rotated and moved from the home position to the standby position. As used herein, the standby position of the return holder 50 means a position in which the return holder 50 projects to the outside of the apparatus above the pair of bundle discharge rollers 130 so as to be located above the discharged sheet.

When the aligning members 1 and 1 and the return holder 50 are located in the standby positions, the sheet in which a page is properly imposed to form the image is sequentially discharged from the copying machine main body 600 and delivered to the pair of entrance rollers 102, and then the sheet is conveyed to the lower stack tray 137 (S804). When the rear end of the conveyed sheet passes through the nip between the pair of bundle discharge rollers 130 (S805), the return holder 50 is lowered from the standby position to the abutment position. Therefore, a drop of the sheet from the position immediately after the sheet passes through the nip between the pair of bundle discharge rollers 130 onto the lower stack tray 137 is assisted. That is, by moving the return holder 50 from the standby position to the abutment position, the sheet can forcedly be dropped immediately after the sheet passes through the nip between the pair of bundle discharge rollers 130, and a drop time can be shortened.

Because the driving source is shared by the pair of bundle discharge rollers 130 and the tray paddle 40, the pair of bundle discharge rollers 130 and the tray paddle 40 rotate simultaneously, which allows the sheet to abut on the abutment portion 170 on the lower stack tray 137. That is, the aligning process in the conveying direction is simultaneously performed at the same time as the lowering (S806). The timing, in which the return holder 50 is lowered since the rear end of the sheet passes through the nip between the pair of bundle discharge rollers 130, is controlled such that the return holder 50 is lowered after a predetermined time since the rear end of the sheet passes through a lower discharge sensor 129. For example, the timing can be set according to sheet information on a size or a basis weight of the discharged sheet, the existence or nonexistence of the image formation, and the like.

The return holder 50 performs the abutment operation in the abutment position, and the abutment operation is ended after a predetermined time elapses. Then, the return holder 50 is rotated and moved to the standby position again (S807). For example, the time period during which the return holder 50 is located in the abutment position can be set according to the sheet information on the size or the basis weight of the discharged sheet, the existence or nonexistence of the image formation, and the like.

The return holder 50 is moved to the standby position, and the sheet lands in the lower stack tray 137. Then, the aligning members 1 and 1, which wait in a position that is larger than the length in the front-back direction of the sheet by a predetermined amount, are moved so as to become the same width as the sheet width, and the aligning process in the width direction is performed (S808). When the aligning process in the width direction is completed, the aligning members 1 and 1 are lifted and moved to the sheet reception lifting and lowering position (standby position) again. The above operation is performed every discharged sheet. When the aligning process of the last sheet is completed, the aligning members 1 and 1 and the return holder 50 are moved to the retracting position to end the job (S809 and S810).

Figure 18:
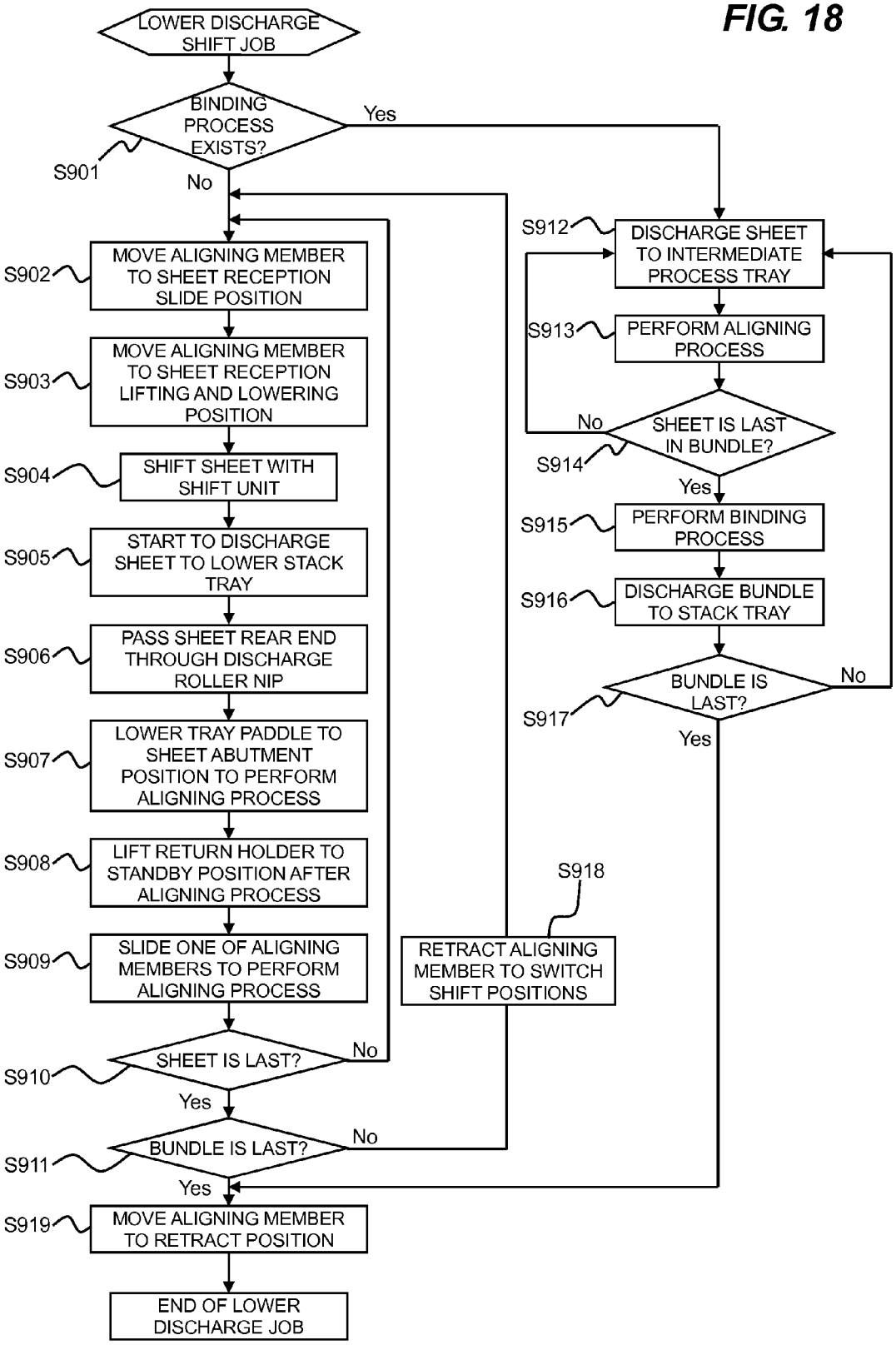
FIG. 18 is a flowchart illustrating the aligning process in the unbound process mode of the sheet to which a shift process is already performed.

Next, an offset unbound process mode, which is performed when an unbound sheet to which the shift process is already performed, is discharged onto the lower stack tray 137 will be described with reference to FIGS. 18 to 19L. FIG. 18 is a flowchart illustrating the aligning process in the unbound process mode of the sheet to which the shift process is already performed. FIGS. 19A to 19L are views illustrating the aligning process of the sheet to which the shift process is already performed.

When an unbound sort mode is set to start the job (S901), the initial operations of the aligning members 1 and 1 and the return holder 50 of the front aligning unit 220 and the back aligning unit 210 are performed to move the aligning members 1 and 1 and the return holder 50 to the home positions. In the case that the binding process is performed, the description of the aligning process (S912 to S917) on the intermediate process tray 138 is not given. Because the detection of the home position is identical to that of the unbound process mode, the description is not repeated. Hereinafter, a suffix "a" is added to the numeral for the aligning member of the front aligning unit 220 and the member constituting the aligning member, and a suffix "b" is added to the numeral for the aligning member of the back aligning unit 210 and the member constituting the aligning member.

When the aligning members 1*a* and 1*b* and the return holder 50 are located in the home positions by the initial operation, the aligning members 1*a* and 1*b* and the return holder 50 are moved to the standby positions in which the sheet is received. The aligning members 1*a* and 1*b* are moved to the sheet reception positions in the shift process according to input sheet size information (S902). As used herein, the reception position in the shift process means a position in which, for example, in the case that shift stack (offset stack) is performed on the back side of the lower stack tray 137, the aligning member 1*a* is located so as to wait in a front-side end part abutment position of the sheet located in a shift stack position. At this point, the aligning member 1*b* is located so as not to interfere with the sheet that is discharged while shifted by the shift unit 108.

Figure 19A:
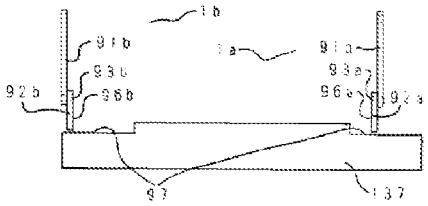
FIGS. 19A to 19L are views illustrating the aligning process of the sheet to which the shift process is already performed.

Then the aligning members 1*a* and 1*b* are lowered from the sheet reception position by a predetermined amount, and moved to the sheet reception lifting and lowering position (standby position) in FIG. 19A (S903). Similarly the return holder 50 is also rotated and moved from the home position to the standby position.

Figure 20A:
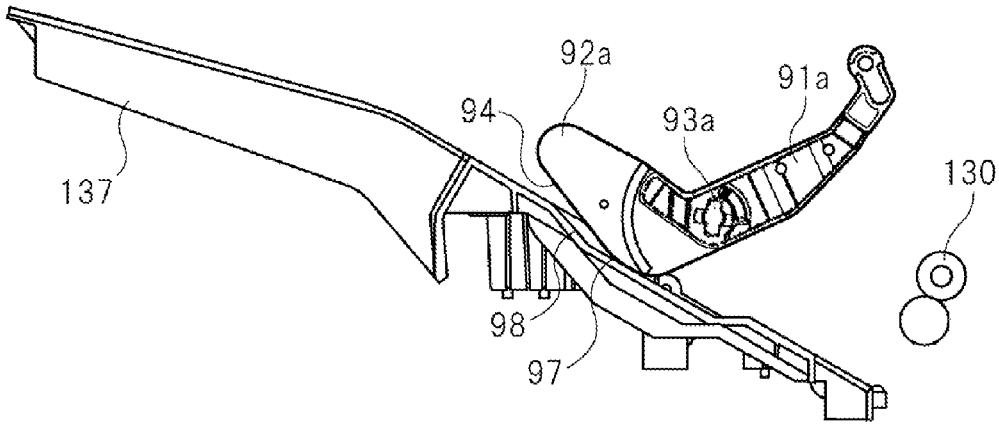
FIG. 20A is a view illustrating the second aligning member that abuts on a depression of the lower stack tray.
Figure 20B:
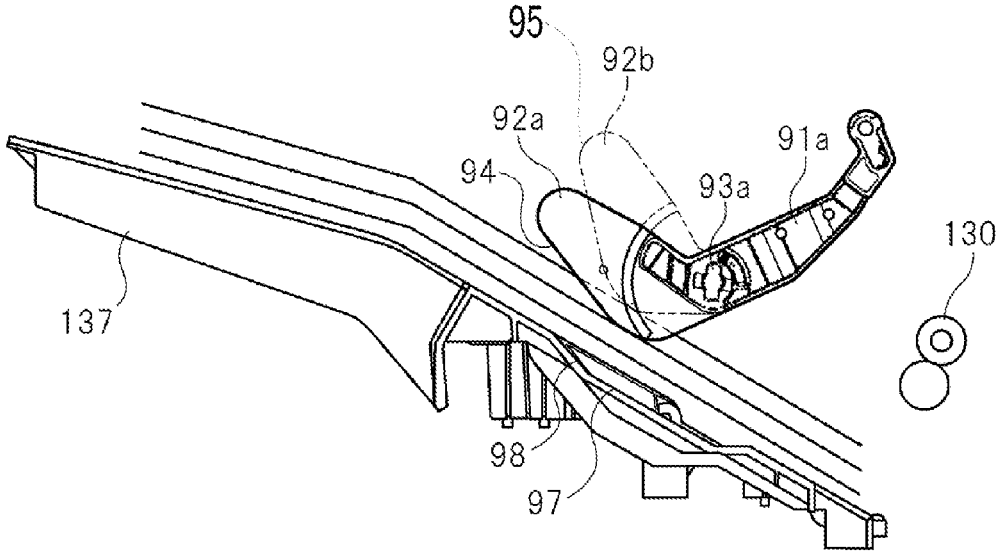
FIG. 20B is a view illustrating the second aligning member that abuts on the sheets stacked on the lower stack tray.

As illustrated in FIG. 20A, in the aligning members 1*a* and 1*b* located in the sheet reception position in FIG. 19A, the second aligning members 92*a* and 92*b* invade (proceed) into depressions 97 formed on both sides of the stacking surface of the lower stack tray 137. The depression 97 is formed into a depressed shape 98 in which the ridge lines 94 of the second aligning members 92*a* and 92*b* become substantially parallel to each other, and the depression 97 is formed into a shape in which the alignment surface 96 that presses the lateral end part of the sheet is widened. As illustrated in FIG. 20B, each of the ridge lines 94 of the second aligning members 92*a* and 92*b* is formed into a shape in which, when abutting on the stacked sheet, each of the second aligning members 92*a* and 92*b* rotates about the rotating shaft 93 while the abutment state is maintained. The aligning members 1*a* and 1*b* in FIG. 20 have the same shape as the aligning member in FIG. 11, and the aligning members 1 and 1 in FIG. 6 are also formed into the same shape.

When the aligning members 1*a* and 1*b* and the return holder 50 are located in the standby positions, the sheet in which the image is formed is sequentially discharged from the copying machine main body 600 and delivered to the pair of entrance rollers 102, and then the sheet is conveyed to the shift unit 108 that is of the sort processing portion through the conveying path 103. The shift unit 108 performs the offset process of shifting the sheet P to the back side by a predetermined amount (S904). The sheet to which the shift process is already performed is conveyed to the bundle conveying path 121.

Then the sheet P is conveyed to a lower path 126 by the saddle path switching member 125, and the sheet is conveyed to the lower stack tray 137 from the pair of lower discharge rollers 128 through the pair of bundle discharge rollers 130 (S905). When the conveyed sheet P passes through the nip between the pair of bundle discharge rollers 130, the return holder 50 that supports the tray paddle 40 is lowered from the standby position to the abutment position, and the sheet P is abutted on the abutment portion 170 to perform the aligning process in the discharge direction (S906 and S907). At this point, the timing, in which the return holder 50 is lowered since the rear end of the sheet passes through the nip between the pair of bundle discharge rollers 130, is controlled such that the return holder 50 is lowered after the predetermined time since the rear end of the sheet passes through the lower discharge sensor 129. For example, the timing can be set according to the sheet information on the size or the basis weight of the discharged sheet, the existence or nonexistence of the image formation, and the like.

The return holder 50 performs the abutment operation in the abutment position, and the abutment operation is ended after the predetermined time elapses. Then, the return holder 50 is rotated and moved to the standby position again (S908). For example, the time period during which the return holder 50 is located in the abutment position can be set according to the sheet information on the size or the basis weight of the discharged sheet, the existence or nonexistence of the image formation, and the like.

Figure 19B:
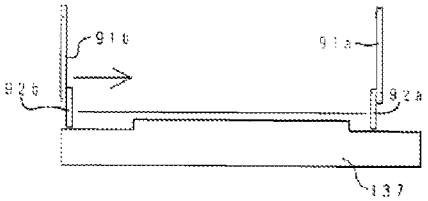
Figure 19C:
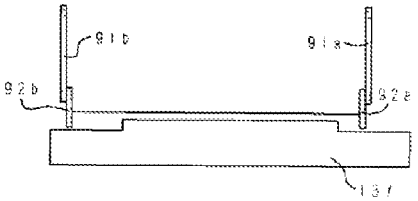
Figure 19D:
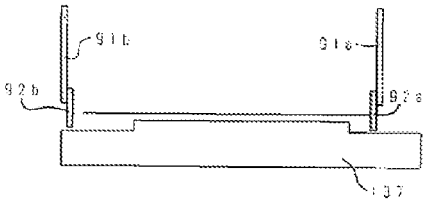
Figure 19E:
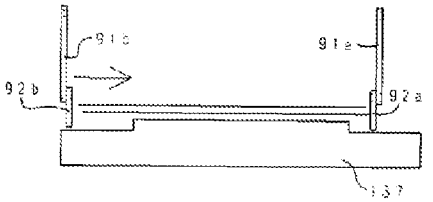
Figure 19F:
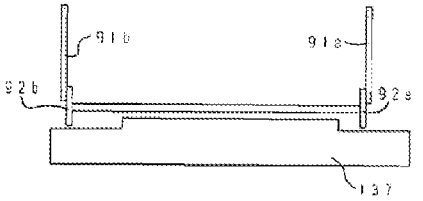

When the return holder 50 rotates to the standby position, as illustrated in FIGS. 19B and 19C, the aligning member 1*b* is moved in the width direction until the sheet P abuts on the aligning member 1*a*, and the aligning process in the width direction is performed to the sheet P (S909). When the aligning process in the width direction is completed, the aligning member 1*b* is moved to the standby position in FIG. 19D again to prepare the reception of the next sheet. The above-described operation is performed every discharged sheet (see FIGS. 19E and 19F). When the aligning process of the last sheet is completed, the shift positions are switched (S910 and S911).

In switching the shift positions, the aligning members 1*a* and 1*b* are lifted by a predetermined amount using the aligning-member lifting and lowering motor M11, and the aligning members 1*a* and 1*b* are moved in a direction in which the aligning members 1*a* and 1*b* are separated from the sheet bundle (in the embodiment, front-back direction) (S918). The aligning members 1*a* and 1*b* are moved to the sheet reception positions in the shift stack in order to perform the shift stack on the front side of the lower stack tray 137 (S902). At this point, the aligning member 1*b* waits in a back-side end part abutment position of the sheet located in the shift stack position, and the aligning member 1*a* waits in the position so as not to interfere with the sheet that is discharged while shifted by the shift unit 108.

Figure 19G:
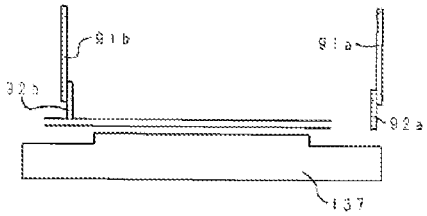

Then the aligning members 1*a* and 1*b* are lowered by a predetermined amount from the sheet reception position, and moved to the sheet reception lifting and lowering position (standby position) (S903). At this point, as illustrated in FIG. 19G, the aligning member 1*b* abuts on the uppermost sheet of the sheet bundle. At this point, as illustrated in FIG. 20B, the aligning member 1*b* becomes a ridge line 95 such that the second aligning member 92*b* does not cut into the sheet bundle. Therefore, a trouble, in which the second aligning member 92*b* rotates upward about the rotating shaft 93*b* to deviate the sheet bundle due to the aligning member 1*b* placed on the sheet bundle, can be prevented. The second aligning member 92*b* rotates about the rotating shaft 93*b* such that a rotating angle of the first aligning member 91*a* of the aligning member 1*b* that abuts on the sheet becomes equal to a rotating angle of the first aligning member 91*a* of the aligning member 1*a* (moves onto the side of the finisher 100). Therefore, the alignment surface of the second aligning member 92*a* of the aligning member 1*b* and the alignment surface of the second aligning member 92*b* of the aligning member 1*a* form opposite surfaces matched with each other in the width direction (see FIG. 20B).

At this point, the sheet is discharged to the position in which the shift unit 108 shifts the sheet by the predetermined amount onto the front side of the back-side end part abutment position of the sheet located in the sheet stacking position. When the sheet passes through the nip between the pair of bundle discharge rollers 130, the return holder 50 is lowered to the abutment position to perform the aligning process in the discharge direction (S905 to S907). The return holder 50 performs the abutment operation in the abutment position, and the abutment operation is ended after the predetermined time elapses. Then, the return holder 50 is rotated and moved to the standby position again (S908). The timing in which the return holder 50 is lowered and the time period during which the return holder 50 is located in the abutment position at this time are identical to those described above.

Figure 19H:
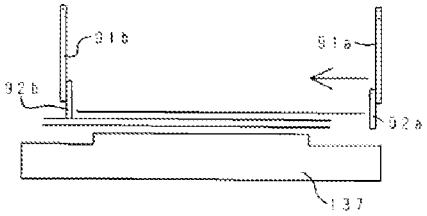
Figure 19I:
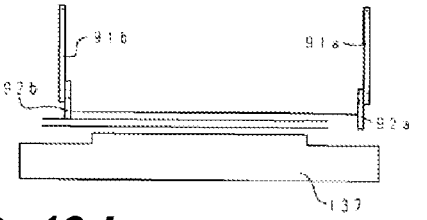
Figure 19J:
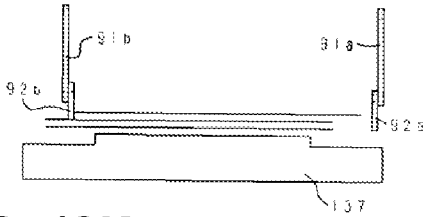
Figure 19K:
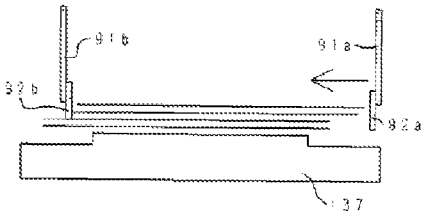
Figure 19L:
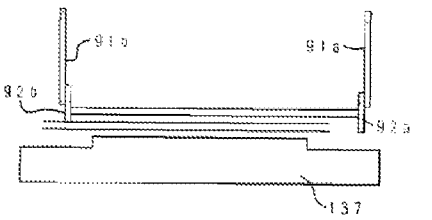

When the return holder 50 rotates to the standby position, as illustrated in FIGS. 19H and 19I, the aligning member 1*a* is moved in the width direction until the sheet P abuts on the aligning member 1*b*, and the aligning process in the width direction is performed to the sheet P (S909). When the aligning process in the width direction is completed, the aligning member 1*a* is moved to the standby position in FIG. 19J again to prepare the reception of the next sheet. The above operation is performed every discharged sheet (see FIGS. 19K and 19I). When the next sheet bundle exists after the aligning process of the last sheet is completed, the shift positions are switched (S910 and S911). On the other hand, when the next sheet bundle does not exist, the aligning members 1*a* and 1*b* and the return holder 50 are moved to the retracting positions to end the job (S919).

Figure 21A:
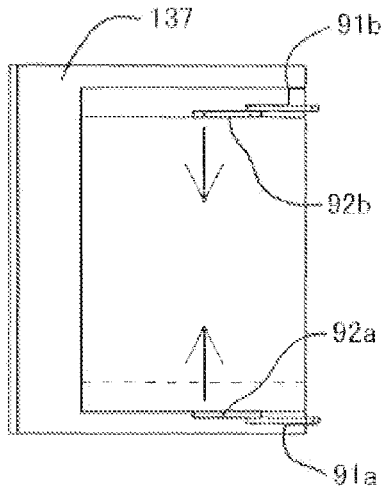
FIGS. 21A to 21D are views comparing configurations of aligning members of the related art and the embodiment.
Figure 21C:
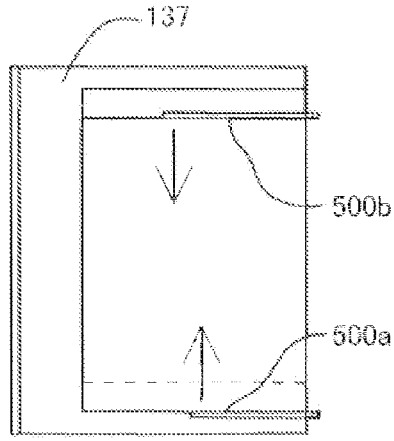
FIG. 21C PRIOR ART
Figure 21B:
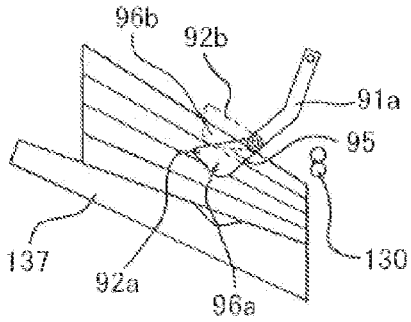
Figure 21D:
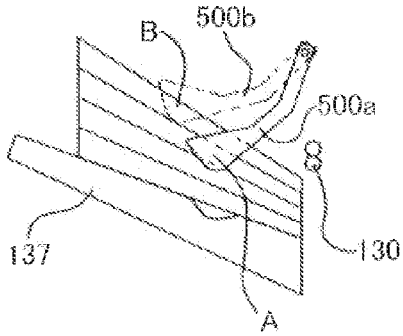
FIG. 21D PRIOR ART

The aligning members 1*a* and 1*b* are located distant from the uppermost sheet (or sheet bundle) because the rotating centers of the aligning members 1*a* and 1*b* are located above. In the case that the aligning process is performed to the sheet to which the shift process is already performed (or sheet bundle), it is necessary that one of the aligning members 1*a* and 1*b* be located below in order to prevent the sheet, which should be aligned in the width direction, from passing below the aligning members 1*a* and 1*b*. Therefore, in aligning members 500*a* and 500*b* of the related art, as illustrated in FIGS. 21C and 21D, an alignment surface A of the aligning member 500*a* and an alignment surface B of the aligning member 500*b* are separated in the discharge direction. Therefore, when the aligning operation is performed while the alignment surface A of the aligning member 500*a* and the alignment surface B of the aligning member 500*b* are separated in the discharge direction, the positions that press the sheet are deviated on the front side and the back side (arrow direction in FIG. 21C), and a torque is provided to the sheet to disturb the alignment.

On the other hand, in the embodiment, the second aligning members 92*a* and 92*b* are supported while being vertically rotatable about the rotating shafts 93*a* and 93*b*. For example, the second aligning member 92*b* can rotate about the rotating shaft 93*b* such that the rotating angle of the first aligning member 91*b* of the aligning member 1*b* that abuts on the sheet becomes equal to the rotating angle of the first aligning member 91*a* of the aligning member 1*a* (moves onto the side of the finisher 100). Therefore, the alignment surface of the second aligning member 92*b* of the aligning member 1*b* and the alignment surface of the second aligning member 92*a* of the aligning member 1*a* can form the opposite surfaces matched with each other in the width direction (see FIG. 21B). As a result, the provision of the torque to the sheet, which is caused by the deviations of the positions that press the sheet on the front side and the back side, can be prevented in performing the aligning operation. That is, the sheet stacking apparatus, which can suitably align the sheet even in the case that the aligning process is performed to the sheet to which the shift process is already performed, and the image forming apparatus, can be provided.

This is effectively applied to the case that the upstream side and the downstream side in the discharge direction differ from each other in a thickness of the sheet bundle when the sheet is curled.

In the embodiment, the depressions 97 are formed on both the sides in the width direction of the lower stack tray 137, and each of the lower end parts of the second aligning members 92*a* and 92*b* is formed into the ridge line 94 along the depressed shape 98 of the depression 97, so that the second aligning members 92*a* and 92*b* can be moved in the width direction along the depression 97. Therefore, for example, even in the case that the first sheet is stacked on the lower stack tray 137, the sheet can be prevented from passing below the second aligning members 92*a* and 92*b*, and the aligning process can suitably be performed. The depressed shapes may be formed at least both the sides in the width direction of the lower stack tray 137.

When the second aligning members 92*a* and 92*b* abut on the sheet or the lower stack tray 137, the ridge lines 94 of the second aligning members 92*a* and 92*b* are formed into the shapes in which the second aligning members 92*a* and 92*b* vertically rotate about the rotating shafts 93*a* and 93*b* while the abutment states are maintained. Therefore, even if the second aligning members 92*a* and 92*b* abut on the sheet, the second aligning members 92*a* and 92*b* can vertically rotate without cutting into the sheet.

A positional relationship among the rotating shaft 93 of the second aligning member 92, the lower stack tray 137, and the second aligning member 92 will be described below with reference to FIGS. 22 to 24. FIGS. 22A to 22D are views illustrating a region where the rotating shaft 93 of the second aligning member 92 is disposed in order to prevent the sheet from passing below the second aligning member 92. FIGS. 23A to 23C are views illustrating a region where the rotating shaft 93 of the second aligning member 92 is disposed in order to prevent the second aligning member 92 from moving the previously-stacked sheet during the rotating of the first aligning member 91. FIGS. 24A to 24D are views illustrating a region, where the rotating shaft 93 of the second aligning member 92 is disposed in order to prevent the first aligning member 91 from interfering with the sheet during the rotating of the first aligning member 91 to the alignment position, and a region, where the rotating shaft 93 of the second aligning member 92 is disposed and the regions in FIGS. 22 and 23 are covered. The aligning member in FIGS. 22 to 24 has the same shape as the aligning member in FIG. 11, and the aligning members 1 and 1 in FIG. 6 are also formed into the same shape.

Figure 22A:
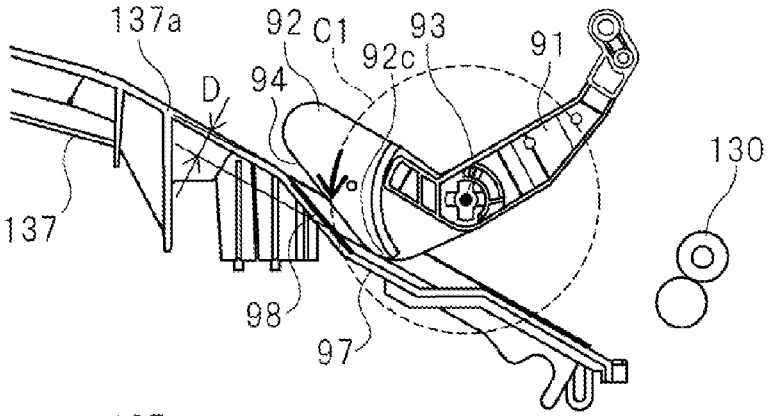
FIGS. 22A to 22D are views illustrating a region where a rotating shaft of the second aligning member is disposed in order to prevent the sheet from passing below the second aligning member.
Figure 23A:
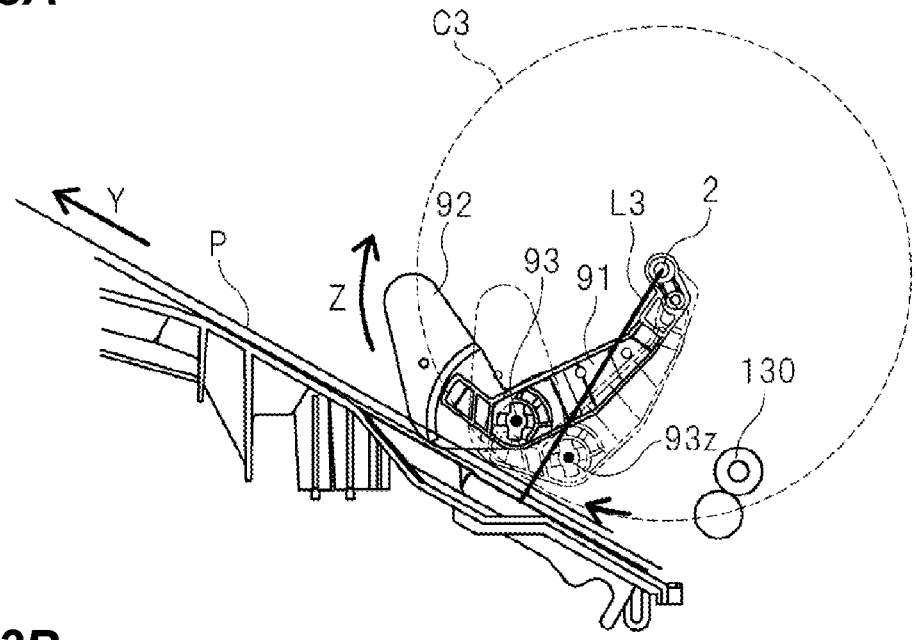
FIGS. 23A to 23C are views illustrating a region where the rotating shaft of the second aligning member is disposed in order to prevent the second aligning member from moving the previously-stacked sheet during the rotating of the first aligning member.
Figure 23B:
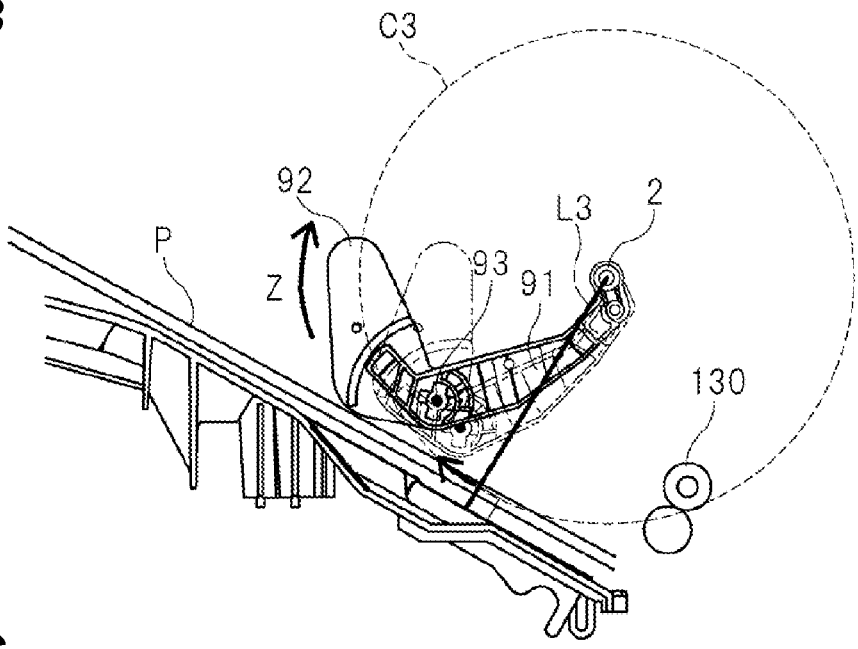
Figure 23C:
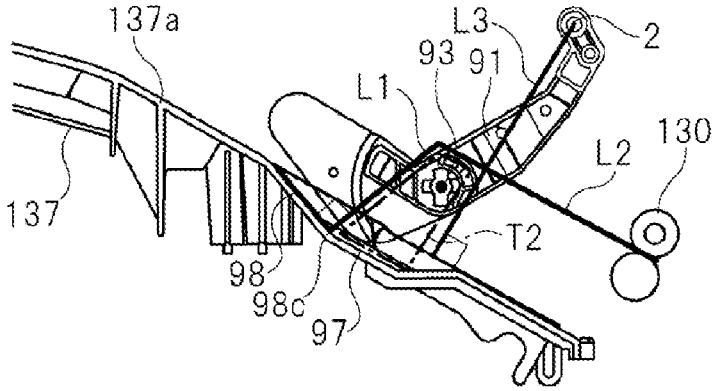

As illustrated in FIG. 22A, the rotating shaft 93 of the second aligning member 92 is disposed such that the rotating region of the second aligning member 92 becomes a locus C1 indicated by a broken line when the first aligning member 91 rotates to locate the second aligning member 92 in the alignment position. The locus C1 is one in which the rotating shaft 93 is centered in a direction, in which the second aligning member 92 cuts into the depressed shape of the lower stack tray 137, when the second aligning member 92 is located in the alignment position. The second aligning member 92 invades into the depression 97 located below a stacking surface 137*a* of the lower stack tray 137, and a distance D with a lowermost surface 92*c* of the second aligning member 92 can be ensured when the stacking surface 137*a* and the second aligning member 92 rotate to the alignment position. Therefore, the sheet can be prevented from passing below the second aligning member 92.

Figure 22B:
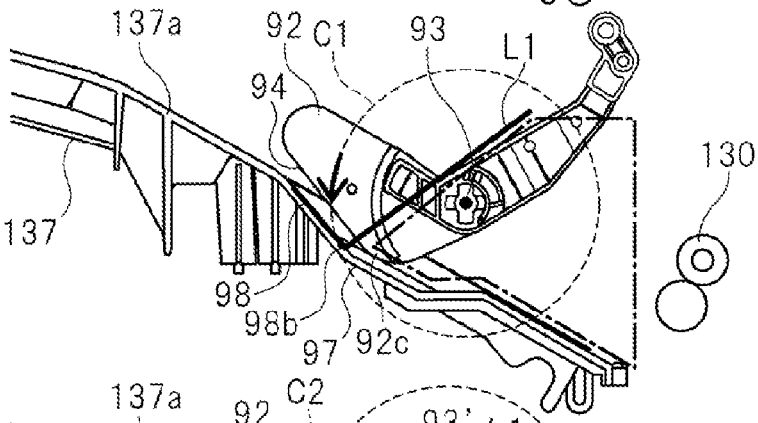
Figure 22C:
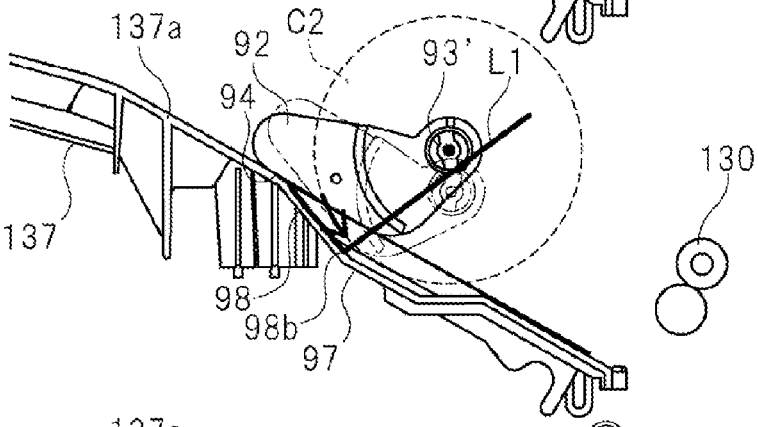

As illustrated in FIG. 22B, the rotating shaft 93 of the second aligning member 92 is disposed in a region indicated by an alternate long and short dash line, which is located on the upstream side in the discharge direction from a normal line L1 (a straight line drawn from a lowest point 98*b* in a direction orthogonal to the depressed shape 98) of the lowest point 98*b* that is of the lowest part of the depressed shape 98. Therefore, the second aligning member 92 can efficiently rotate in the direction in which the second aligning member 92 cuts into the depressed shape 98 of the lower stack tray 137. On the other hand, for example, when a rotating shaft 93' is disposed on the downstream side in the discharge direction from the normal line L1 as illustrated in FIG. 22C, the second aligning member 92 rotates so as to draw a locus C2 in a direction (tangential direction) in which the second aligning member 92 is separated from the depression 97. Therefore, the distance D with the stacking surface 137*a* of the lower stack tray 137 in FIG. 22A is hardly ensured, and possibly the sheet passed below the second aligning member 92 to generate the stack deviation.

Figure 22D:
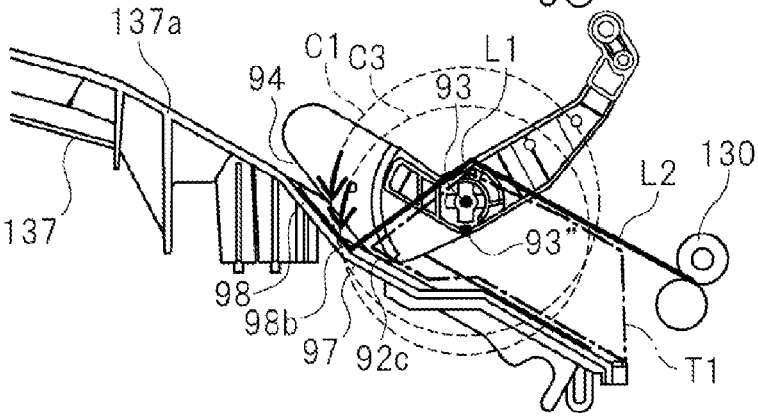

For example, when a rotating shaft 93" is disposed below the rotating shaft 93 as illustrated in FIG. 22D, the rotating region of the second aligning member 92 becomes a locus C3, the rotating shaft 93" further cuts into the depressed shape of the lower stack tray 137 compared with the rotating shaft 93. The rotating shaft 93" has an advantage over the rotating shaft 93 from the viewpoint of preventing the sheet from passing below the second aligning member 92, and therefore the rotating shaft 93 is disposed in the lower position as much as possible. In the embodiment, the rotating shaft 93 is disposed below a nip line L2 of the pair of bundle discharge rollers 130. The rotating shaft 93 is disposed in the lower position with in a region T1 indicated by the alternate long and short dash line in FIG. 22D, which allows the sheet to be prevented from passing below the second aligning member 92.

As illustrated in FIG. 23A, when the second aligning member 92 abuts on the previously stacked sheet P of the lower stack tray 137, the rotating shaft 93 of the second aligning member 92 is disposed on the downstream side in the discharge direction from a line L3 perpendicular to the stacking surface 137*a* from the first aligning support shaft 2 of the first aligning member 91. This is because, in switching the shift direction, the movement of the previously-aligned sheet P stacked on the lower stack tray 137 is prevented when the first aligning member 91 rotates upward to retract the second aligning member 92 from the position in which the second aligning member 92 abuts on the sheet. For example, when the rotating shaft is located on the upstream side in the conveying direction from the perpendicular line L3 like a rotating shaft 93*z*, the rotating region of the second aligning member 92 becomes the locus C3 to cut into the previously-stacked sheet P in rotating the first aligning member 91 in a direction of an arrow z about the first aligning support shaft 2. Therefore, when the first aligning member 91 rotates, the previously-stacked sheet P is moved in a direction of an arrow Y to generate the stack deviation.

On the other hand, as illustrated in FIG. 23B, when the rotating shaft 93 is disposed on the downstream side in the discharge direction from the line L3 perpendicular to the lower stack tray 137 from the first aligning support shaft 2, the first aligning member 91 rotates in a direction of an arrow z such that the locus C3 is separated from the previously-stacked sheet P. Therefore, the previously-stacked sheet P is not moved, and the stack deviation of the previously-stacked sheet P, which is generated by the rotating of the first aligning member 91, can be prevented. Accordingly, in the embodiment, the rotating shaft 93 of the second aligning member 92 is disposed on the downstream side in the discharge direction from the line L3 perpendicular to the stacking surface 137*a* of the stacking lower stack tray 137 from the first aligning support shaft 2.

The rotating shaft 93 is disposed in a region T2 indicated by an alternate long and short dash line in FIG. 23C in consideration of the condition in FIG. 22 that the sheet does not pass below the second aligning member 92 and the condition in FIGS. 23A and 23B that the previously-stacked sheet P is not moved when the second aligning member 92 retracts from the alignment position. That is, the region T2 is surrounded by the normal line L1 drawn from the lowest point 98*c* of the depressed shape 98, the nip line L2 of the pair of bundle discharge rollers 130, the line L3 perpendicular to the stacking surface 137*a* of the stacking lower stack tray 137 from the first aligning support shaft 2, and the depression 97 of the lower stack tray 137.

Figure 24A:
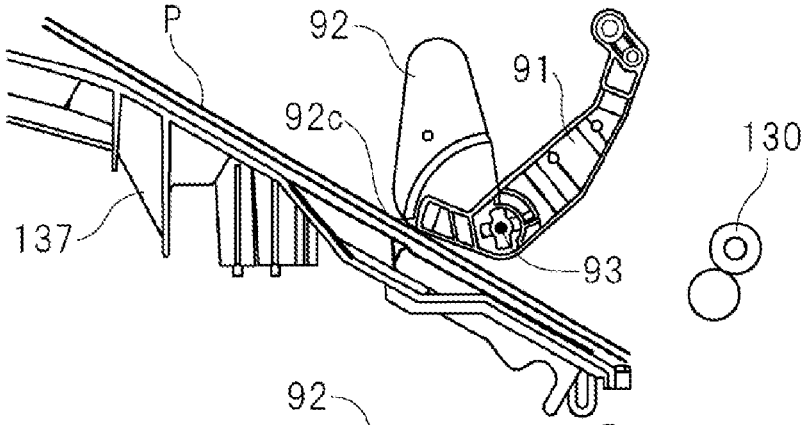
FIGS. 24A to 24D are views illustrating a region, where the rotating shaft of the second aligning member is disposed in order to prevent the first aligning member from interfering with the sheet during the rotating of the first aligning member to an alignment position, and a region, where the rotating shaft of the second aligning member is disposed and the regions in FIGS. 22 and 23 are covered.
Figure 24B:
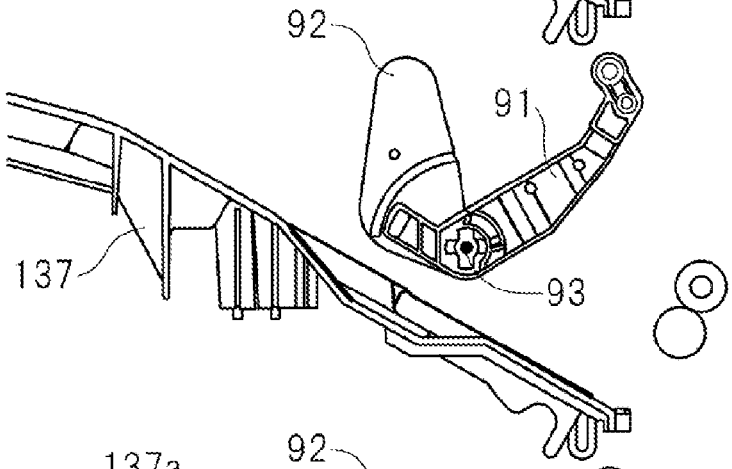

On the other hand, the first aligning member 91 rotates about the first aligning support shaft 2, the first aligning member 91 rotates to the alignment position again after retracting from the alignment position, and the second aligning member 92 abuts on the sheet P. At this point, as illustrated in FIG. 24A, the second aligning member 92 abuts on the sheet P to rotate upward about the rotating shaft 93. Therefore, the lowermost surface 92*c* of the second aligning member 92 abuts on the sheet P in a normal state in which the sheet P is not curled. However, as illustrated in FIG. 24B, when the sheet is discharged from the pair of bundle discharge rollers 130 and stacked on the lower stack tray 137 while the sheet is curled, particularly the sheet is curled upward, the rear end side of the sheet P rises by the curled amount to lift the stacking surface. Although originally the second aligning member 92 abuts on the sheet to rotate upward, possibly the lowermost surface 91*c* of the first aligning member 91 abuts on the sheet. In the case that the first aligning member 91 abuts on the sheet, when the first aligning member 91 is rotated by the aligning-member lifting and lowering motor M11, the first aligning member 91 interferes with the previously-stacked sheet P, possibly the first aligning member 91 cannot normally be operated such that the sheet P becomes a resistance to generate step-out of the aligning-member lifting and lowering motor M11.

Figure 24C:
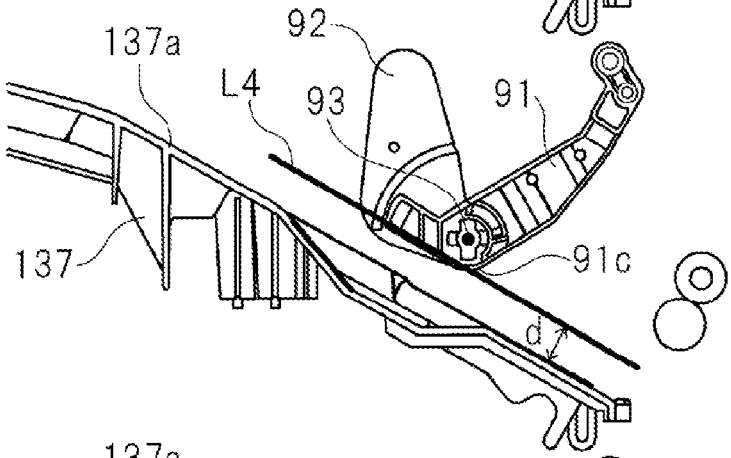

Therefore, as illustrated in FIG. 24C, the stacking surface 137*a* and the lowermost surface 91*c* of the first aligning member 91 are separated by a predetermined distance d such that lowermost surface 91*c* of the first aligning member 91 does not abut on the sheet P even if the upwardly-curled sheet P is stacked. Therefore, even if the upwardly-curled sheet P is stacked in rotating the first aligning member 91, the first aligning member 91 and the sheet P do not interfere with each other, but the first aligning member 91 can normally be operated. The first aligning member 91 and the lowermost surface 91*c* of the first aligning member 91 are separated from the stacking surface 137*a* by a distance d when the first aligning member 91 rotates to the alignment position, and the rotating shaft 93 of the second aligning member 92 is located above a straight line L4, which is separated from stacking surface 137*a* by the distance d, by a predetermined amount.

Figure 24D:
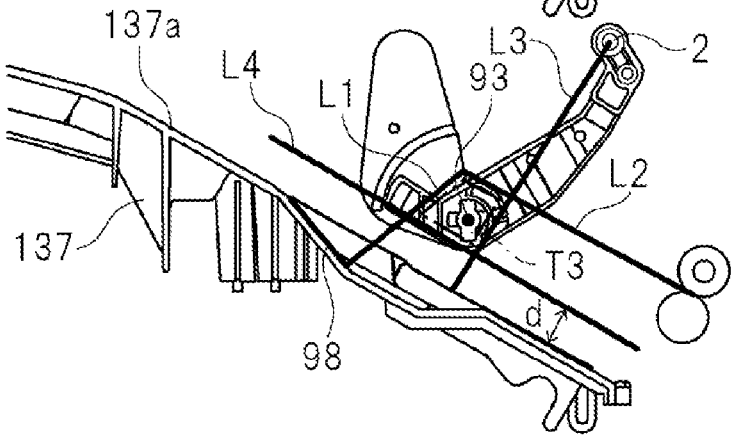

As illustrated in FIG. 24D, the rotating shaft 93 is disposed in a region T3 surrounded by the straight lines L1 to L4 from the viewpoint of preventing the sheet from passing below the second aligning member 92 in FIGS. 22 and 23, preventing the movement of the previously-stacked sheet P, and preventing the first aligning member from interfering with the previously-stacked sheet P.

As described above, by disposing the rotating shaft 93 of the second aligning member 92 in the region T3, the sheet can be prevented from passing below the second aligning member 92 in aligning the discharged sheet, and the movement of the previously-stacked sheet can be prevented in upwardly retracting the second aligning member 92. The trouble, in which the first aligning member 91 interferes with the sheet to have an effect on the operation of the first aligning member 91, can be prevented when the first aligning member 91 rotates to the alignment position.

Although the embodiment of the invention is described above, the invention is not limited to the embodiment. Only the most suitable effects are cited in the embodiment of the invention, and the effect of the invention is not limited to the effects described in the embodiment of the invention.

For example, in the invention, the shift stack is started from the back side. Alternatively, the shift stack may be started from the front side.

In the embodiment, the first aligning member 91 rotates about one rotating shaft. However, the invention is not limited to the embodiment. The first aligning member 91 may be configured to include at least two rotating shafts (rotating centers). When the first aligning member 91 includes at least two rotating shafts, the alignment surface of the second aligning member 92*b* of the aligning member 1*b* and the alignment surface of the second aligning member 92*a* of the aligning member 1*a* can form the opposite surfaces matched with each other in the width direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-167589, filed Jul. 29, 2011, and No. 2012-103012, filed Apr. 27, 2012, which are hereby incorporated by reference herein in their entirety.

What is claimed is:

1. A sheet stacking apparatus comprising:

a discharge portion which discharges a sheet;

a sheet stacking portion on which the sheet discharged by the discharge portion is stacked;

an aligning portion which includes a pair of aligning arms and a pair of aligning members, the pair of aligning arms being supported while being downwardly and upwardly rotatable, and movable in a width direction orthogonal to a discharge direction of the sheet, the pair of aligning members being supported at a leading end of the pair of aligning arms while being downwardly and upwardly rotatable;

a driving portion which rotates the pair of aligning arms and moves the pair of aligning arms in the width direction; and a controller which controls the driving portion, when the sheet discharged by the discharge portion is aligned in a position which is offset in the width direction with respect to the sheet previously stacked on the sheet stacking portion, so that the driving portion rotates the pair of aligning arms downwardly to rotate one of the pair of aligning members upwardly by abutting on an upper surface of a sheet previously stacked on the sheet stacking portion, and so the discharged sheet is aligned with the sheet previously stacked in the width direction by the one of the pair of aligning members and the other which does not abut on the sheet previously stacked on the sheet stacking portion.

2. The sheet stacking apparatus according to claim 1, wherein each of the pair of aligning arms includes at least two rotating centers, and each aligning member rotates about one of the rotating centers when each aligning member abuts on the sheet or the sheet stacking portion.

3. The sheet stacking apparatus according to claim 2, wherein, when each of the pair of aligning members abuts on the sheet or the sheet stacking portion, each aligning member rotates upward about the rotating center while the abutment state is maintained.

4. The sheet stacking apparatus according to claim 1, wherein the sheet stacking portion includes recesses provided on a stacking surface such that the pair of aligning members proceeds below the stacked sheet and such that the pair of aligning members can move in the width direction.

5. The sheet stacking apparatus according to claim 4, wherein each of the pair of aligning members includes a ridge line which is formed along a depressed shape of the recess.

6. The sheet stacking apparatus according to claim 5, wherein each of the pair of aligning members is formed such that a width is widened from a rotating center toward a central part between the rotating center and a leading-end part, and each of the pair of aligning members is formed such that the width is narrowed from the central part toward the leading-end part by the ridge line along the depressed shape of the recess.

7. The sheet stacking apparatus according to claim 6, wherein each of the pair of aligning members includes a groove which nips a leading end of each of the pair of aligning arms to guide each of the pair of aligning members to a rotating direction.

8. The sheet stacking apparatus according to claim 5, wherein a rotating center about which each of the pair of aligning members rotates is located upstream in the discharge direction from a normal line in a lowest part of the depressed shape of the recess when one of the pair of aligning members rotates to form opposite surfaces together with the other of the pair of aligning members.

9. The sheet stacking apparatus according to claim 1, wherein the discharge portion includes a pair of discharge rollers, and a rotating center about which each of the pair of aligning members rotates is located below a nip line formed by the pair of discharge rollers.

10. The sheet stacking apparatus according to claim 1, wherein a lowest part of the pair of aligning arms is located above a stacking surface of the sheet stacking portion by a predetermined amount when the pair of aligning arms rotates to an alignment position, in which the sheet is aligned, and when the pair of aligning members abuts on the sheet to rotate upwardly.

11. The sheet stacking apparatus according to claim 1, wherein, when one of the pair of aligning members rotates to form opposite surfaces together with the other of the pair of aligning members, a rotating center of one of the pair of aligning members is located on a downstream side in the discharge direction from a straight line perpendicular to a stacking surface of the sheet stacking portion from a rotating center of the other of the pair of aligning members.

12. The sheet stacking apparatus according to claim 1, further comprising a shift processing portion on an upstream side in the discharge direction of the discharge portion in order to shift the sheet in the width direction orthogonal to the discharge direction, wherein the aligning portion aligns the sheet to which a shift process is already performed by the shift processing portion.

13. An image forming apparatus comprising:

an image forming portion which forms an image on a sheet; and a sheet stacking apparatus which performs an aligning process to the sheet on which the image is formed by the image forming portion, the sheet stacking apparatus including:

a discharge portion which discharges the sheet;

a sheet stacking portion on which the sheet discharged by the discharge portion is stacked;

an aligning portion which includes a pair of aligning arms and a pair of aligning members, the pair of aligning arms being supported while being downwardly and upwardly rotatable, and movable in a width direction orthogonal to a discharge direction of the sheet, the pair of aligning members being supported at a leading end of the pair of aligning arms while being downwardly and upwardly rotatable;

a driving portion which rotates the pair of aligning arms and moves the pair of aligning arms in the width direction; and a controller which controls the driving portion, when the sheet discharged by the discharge portion is aligned in a position which is offset in the width direction with respect to the sheet previously stacked on the sheet stacking portion, so that the driving portion rotates rotating the pair of aligning arms downwardly to rotate one of the pair of aligning members rotates upwardly by abutting on an upper surface of a sheet previously stacked on the sheet stacking portion, and so that the discharged sheet is aligned in the width direction by the one of the pair of aligning members and the other which does not abut on the sheet previously stacked on the sheet stacking portion.

14. The image forming apparatus according to claim 13, wherein each of the pair of aligning arms includes at least two rotating centers, and each aligning member rotates about one of the rotating centers when each aligning member abuts on the sheet or the sheet stacking portion.

15. The image forming apparatus according to claim 14, wherein, when each of the pair of aligning members abuts on the sheet or the sheet stacking portion, each aligning member rotates upward about a rotating center while the abutment state is maintained.

16. The image forming apparatus according to claim 13, wherein the sheet stacking portion includes recesses provided on a stacking surface such that the pair of aligning members proceeds below the stacked sheet and such that the pair of aligning members can move in the width direction.

17. The image forming apparatus according to claim 13, wherein each of the pair of aligning members includes a ridge line which is formed along a depressed shape of the recess.

18. A sheet stacking apparatus comprising:

a discharge portion which discharges a sheet;

a sheet stacking portion on which the sheet discharged by the discharge portion is stacked;

an aligning portion which includes a pair of aligning arms and a pair of aligning members, the pair of aligning arms being supported while being rotatable downwardly and upwardly, and movable in a width direction orthogonal to a discharge direction of the sheet, the pair of aligning members being supported at a leading end of the pair of aligning arms to align the discharged sheet while being rotatable upwardly by abutting on an upper surface of a sheet previously stacked on the sheet stacking portion.

19. The sheet stacking apparatus according to claim 18, wherein each of the pair of aligning arms includes at least two rotating centers, and each aligning member rotates about one of the rotating centers when each aligning member abuts on the sheet or the sheet stacking portion.

20. The sheet stacking apparatus according to claim 19, wherein, when each of the pair of aligning members abuts on the sheet or the sheet stacking portion, each aligning member rotates upward about the rotating center while the abutment state is maintained.

* * * * *